United States Patent [19]

Sabee

[11] Patent Number: 4,910,064

[45] Date of Patent: Mar. 20, 1990

[54] STABILIZED CONTINUOUS FILAMENT WEB

[76] Inventor: Reinhardt N. Sabee, 728 S. Summit St., Appleton, Wis. 54911

[21] Appl. No.: 198,783

[22] Filed: May 25, 1988

[51] Int. Cl.[4] ..... B32B 5/12

[52] U.S. Cl. ..... 428/113; 156/62.4; 156/62.6; 156/62.8; 428/198; 428/288; 428/293; 428/294; 428/296

[58] Field of Search ..... 428/113, 198, 288, 293, 428/294, 296; 156/62.4, 62.6, 62.8

[56] References Cited

U.S. PATENT DOCUMENTS 4,680,213 7/1987 Fourezon ..... 428/296

*Primary Examiner*—Marion C. McCamish

*Attorney, Agent, or Firm*—Fuller, Puerner & Hohenfeldt

[57] ABSTRACT

A non-woven web is provided that has conformability and drapability approaching that of woven fabrics. The non-woven web comprises a number of substantially parallel continuous filaments that are stabilized by melt blown fibers to create a coherent web. The continuous filaments are molecularly oriented, as by drawing before, during, or after deposition of the melt blown fibers. The melt blown fibers may be deposited on one or both sides of the continuous filaments, and two or more webs may be cross laid and laminated together. In one embodiment, the continuous filaments of a cross laid laminate are not bonded to each other. The continuous filaments are above to slide and slip relative to each other when the laminate is deformed, thereby decreasing stiffness and increasing drapability.

241 Claims, 8 Drawing Sheets

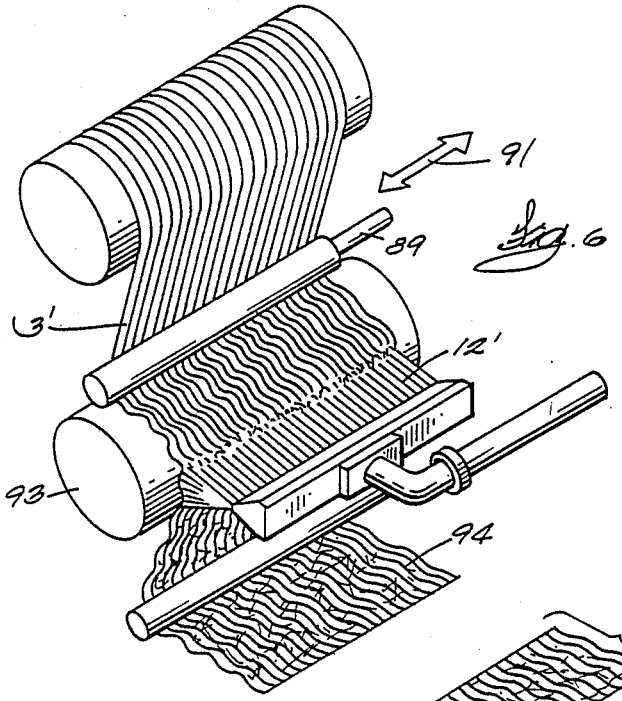
Fig. 6
Fig. 7a
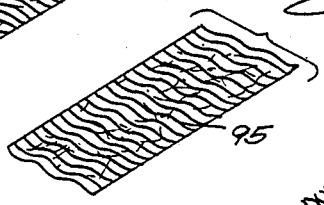
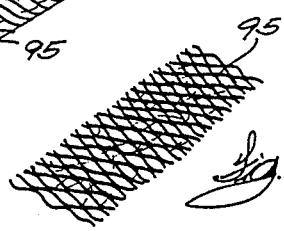
Fig. 7b
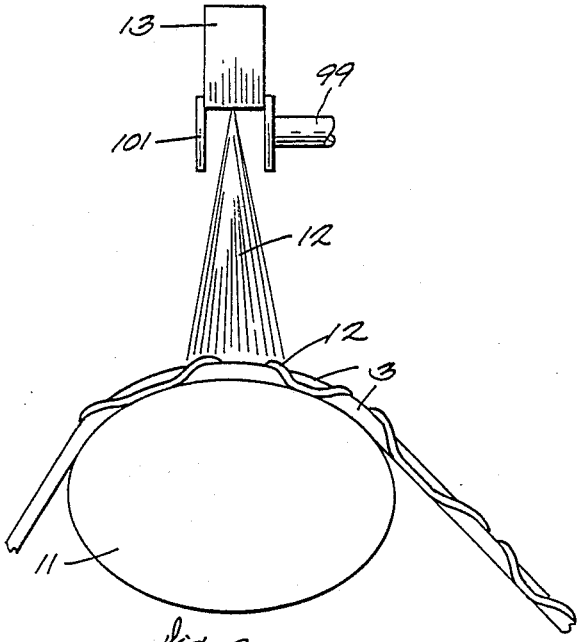
Fig. 9
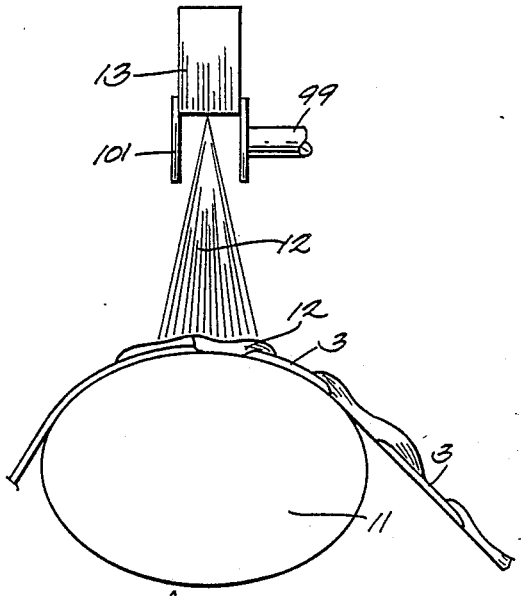
Fig. 10

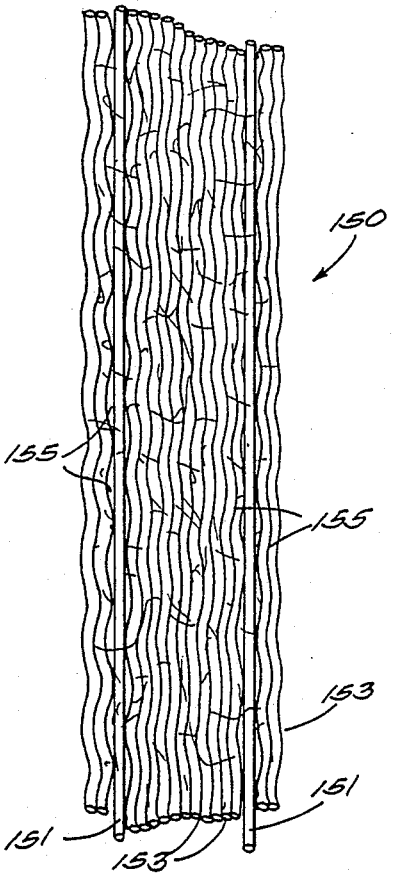
Fig. 20
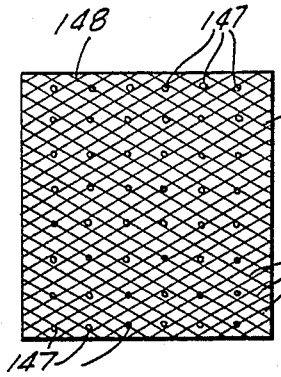
Fig. 17
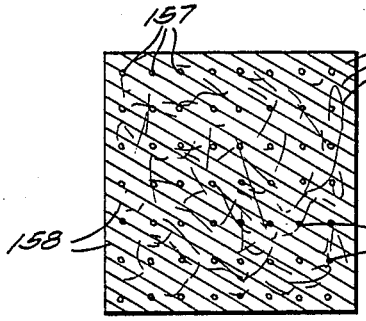
Fig. 18
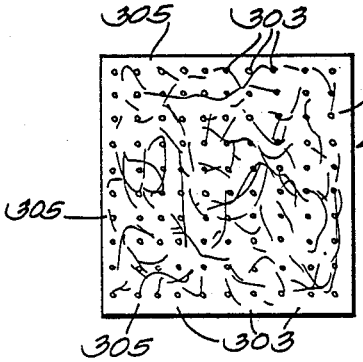
Fig. 19
PRIOR ART
Fig. 21
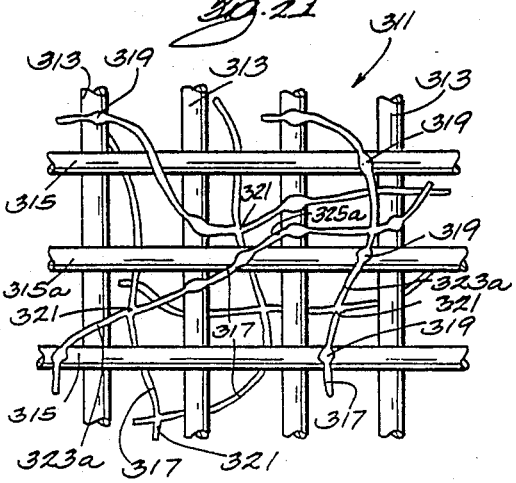
Fig. 22.
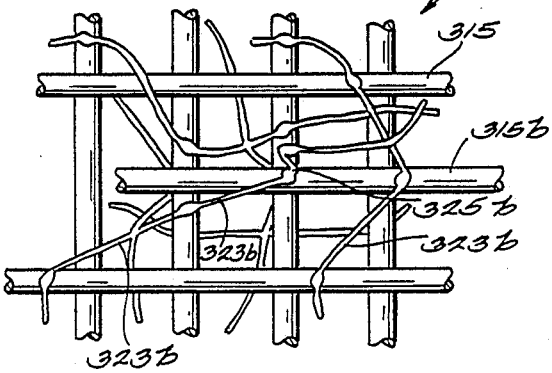

STABILIZED CONTINUOUS FILAMENT WEB

BACKGROUND OF THE INVENTION

The present invention is directed to the improved quality, in uniformity of strength, softness, drapability, and textile-like feel of non-woven webs produced from continuously drawn filaments of spinnable polymeric thermoplastics. The invention relates to the controlled orientation of filaments as laid on a collector in the for of a non-woven web of a coherent structure, and to the controlled molecular orientation of the filaments themselves to provide a fabric-like material of autogenously or self-bonded filaments and fibers. This invention is especially concerned with the stabilization and control of the physical deposition of polymeric filaments on a traveling collector and with increasing the density or quantity of filament intersection points for increased filament bonding without producing any adverse effects on drapability or the soft textile-like hand of the non-woven web.

Non-woven webs comprising a plurality of substantially continuous and randomly deposited, molecularly oriented filaments of thermoplastic polymers are widely known in the art and are finding widespread commercial use. However, there is a great need for non-woven webs having a higher uniformity, better hand, greater strength add a better control of the uniformity of the molecular orientation of the individual filament than are presently available.

Until the instant invention, non-woven webs have been prepared by simultaneously spinning a multiple number of continuous filaments of a synthetic polymer such as polypropylene through a multiple number of spinning nozzles or spinnerets, preferably extending in one or more rows. The filaments are simultaneously drawn through air guns, eductors, or air jet drafters (air suckers) at high velocities in individually surrounding gas columns directed by exit nozzles to impinge on a moving collector, in loop like, overlapping arrangements, where they form a continuous non-woven random laid web which may be consolidated, compacted and stabilized by various bonding techniques such as hot calendering, autogenous spot bonding by passing the web between heated patterned embossing rolls, needle punching, or treating with suitable binders.

The filaments are drawn downwardly at velocities of approximately 600 to 8000 meters per minute in surrounding gas columns flowing at supersonic velocities and impinging on a horizontal carrier which is moving at speeds generally in the range of 150 to 300 yards per minute. This low ratio of web production capability to the filament output results in a relatively uncontrollable random laydown of the filaments with an accompanying adverse effect on the uniformity of strength, opacity, drapability, and soft fabric-like hand. After formation on the carrier, the web is passed between two rollers and lightly compacted prior to passing through the pressure nip of two heated rolls, one of which contains a plurality of raised points on its surface. The amount of prewrap and the roll temperature is critical in that too high a web temperature results in high web shrinkage, film forming effects and over-bonding with its adverse effect on drapability, and can also result in filament degradation with an accompanying reduction in filament tenacity. If the web temperature is to low, the filaments release from their bond points before any substantial strain is applied to the filaments allowing the web to slither apart.

It can be seen that the prior non-woven fabrics are produced by clumsy and quite uncontrollable processes, which also have very low ratios of filament output to web production capability, thereby increasing production costs and capital equipment dollar outlays. In addition, the prior web structures have relatively few filament intersection points, which puts limitations on the mechanical properties in that it is difficult to achieve appropriate bonding without an accompanying adverse film forming effect of the web surface and a deleterious effect on the fabric drapability and hand.

The prior webs all have one thing in common and that is that the filaments are all laid in a looplike random arrangement onto a carrier belt or the like with high velocity are to form a web. Accordingly, they are all subject to the problems associated with air formed webs, such as turbulent air flow with resultant filament intertwining, and plugging of eductors by broken filaments or molten polymer, all of which impart an undesirable non-uniformity in appearance, drapability, tensile strength, opacity, basis weight, and variations in degree of filament entanglement. Variations in the gap space of air jet slits result in non-uniform flowing action of air jets on filaments, resulting in non-uniform webs. Slight variations of the conditions for cooling destroys the uniformity of distribution of the filaments, and difficulties of getting all eductors or air channels to produce filaments having the same characteristics are manifold. The drapability is poor due to the high numbers of autogenous spot bonds required to form a coherent structure and web of commercial integrity. Also, the installation costs and maintenance expenses, and the required capital investment in air handling equipment and ducting for the high volumes of high pressure heated air required for the blasting action of the air jets on the filaments to draw and deposit them on the collecting device are immense. The above described methods require high air consumption of heated air, which in turn consumes huge amounts of power.

Illustrative prior art techniques of the production of substantially continuous filaments are described in the following U.S. Pat. Nos.: Kinney 3,338,992 and 3,341,394; Hartmann 3,502,763, 3509,009, and 3,528,129; Peterson 3,502,538; Dobo et al 3,542,615; Levy 3,276,944; and Talbert 3,506,744, as well as the illustrative techniques described in the U.S. Pat. No. 3,565,729 to Hartmann in which it is disclosed that molten polymer be subject to fusion spinning and drawing by means of directed gas currents, which seize the molten filaments from at least two sides, will produce fibers of high molecular orientation. The gas velocity is adjusted so that the filaments are carried away from the spinneret without breaking off. However, variations in polymer melt flow, melt temperature variations, gas temperature, and gas velocity have an influence on frequency of filament breakage and non-uniformity in appearance, basis weight, and degree of filament entanglement.

U.S. Pat. No. 3,692,618 to Dorschner et al teaches eductive drawing wherein discrete jets are formed which entrai a surrounding fluid in turbulent flow. The polymer melt is extruded through a multiple number of spinnerets extending in a row and are gathered into a straight row of side-by-side evenly spaced apart untwisted bundles. These filament bundles are passed through air guns and deposited on a carrier in a loop-like random arrangement.

U.S. Pat. No. 3,802,817 discloses a large number of monofilaments that are melt spun from a number of orifices and then introduced into a single-nozzle stage sucker having a narrow slit-like passage opening formed vertically through the sucker and located far enough below the orifices to coagulate at least the surfaces of the filaments. The filaments are impinged on both sides by a pair of jet air streams thereby subjecting the curtain-like arranged filaments to cold stretching and deposition on a traveling foraminous belt.

Another prior art spinning process suggests injecting high temperature and high pressure steam at a close proximity to the extrusion spinneret and upon the filaments as extruded in order to increase the filament velocity to draw them and orient the polymer molecules in the direction of the filament axis. However, injecting high temperature, high pressure, and high velocity steam on filaments as extruded leads to frequent filament breakage. This consumption of large quantities of high pressure, high temperature steam increases capital equipment costs, a well as operating costs.

A further improvement proposal suggests providing several stages of nozzles in the sucker to maintain a nearly laminar flow of the sucking and injecting gaseous medium flowing through the sucker. However, the filaments moving through the sucker become entangled, thereby affecting the web uniformity across wide webs.

Eductive type devices, whether they ar air jet drafters ejectors, air suckers, or aspirator jets, require two sources of air supply and compressing equipment, one being a low pressure, cooled air source for quenching the solidifying filament at least to the non-tacky state and the other a high pressure air source to produce high velocity air for drawing the filaments. The requirement of two sets of air compressing equipment, coupled with high precision costly machine work with its associated high installation costs, and high maintenance expenses in turn, results in high production costs of the webs.

The use of high pressure air for educting the low pressure air causes a highly turbulent flow which in turn causes filament intertwining and breakage. Associated with turbulent flow are the difficulties of getting all the air channels and eductors to produce filaments having the same characteristics, which in turn have a deleterious effect on the basis weight profiles due to poor bundle spreading and variations in filament entanglement.

The air supplied to the quench chamber must be free of secondary circulations, low in turbulence, uniform in distribution and cooler than the filaments being extruded. This approach flow must be essentially free of any large scale eddies or vortices. The non-uniformity of the filaments stream and the entanglement of the filaments is an inherent problem with prior methods of producing continuous filament random laid webs. The nozzle openings and the collection distance affect the uniformity of the final web to a high degree in the forming of the loops and migrations of the filaments. Prior equipment has difficulty getting all air channels or eductors to produce filaments having the same characteristics. Problems caused by broken filaments include the plugging of air channels or eductors.

Some of the prior apparatus and methods employ the repulsive forces developed by the application of static high voltage to filament groups, as described in U.S. Pat. No. 3,506,744, to separate large numbers of monofilaments to improve the uniformity of a blasted laydown on a foraminous belt with the use of high velocity air. This method with its associated costly and critical equipment further complicates the process.

The methods of preparing the continuous filament webs described above have at least three common features.

1. Continuously extruding a thermoplastic polymer, either from a melt or a solution, through a spinneret in order to form discrete filaments.

2. The filaments are drawn or drafted by high velocity air in order to molecularly orient the polymeric filaments and achieve tenacity.

3. The filaments are deposited in a blast of high velocity air or gas in a substantially random manner onto a carrier belt or the like to form a web with substantially isotropic physical characteristics.

It can readily be seen that the prior art has been directed towards methods and devices for eliminating processing problems and the non-uniform properties of melt spun and air grafted filaments, which after drafting or having been air drawn are blasted against a foraminous moving collector at a speed of about two to three times the spinning velocity, which in some cases would reach 6000 to 18,000 meters per minute. However, the methods and equipment used leave much to be desired with respect to heat setting of filaments under relaxed or tensile conditions, differential drawing, crimped or incremental drawing, hot or cold drawing under controlled temperature, and uniform drawing conditions while in either a crystalline or amorphous state or in both states.

Filaments that are drawn pneumatically enter a quench chamber, upon exiting from the spinneret, and are immediately drawn and solidified. The filaments are molecularly oriented but not to the extent of filaments subjected to mechanical draw down under numerous, controlled, interrelated processing variables.

Filaments that are drawn mechanically enter a heated or controlled temperature chamber upon exiting the spinneret and are drawn away from the orifice at a greater rate than the rate of extrusion to effect a substantial draw down of the filaments in the molten state prior to solidification thereof. The solidified filaments having a low degree of molecular orientation are then subjected to a mechanical draw down with draw rolls under closely controlled temperature and velocity conditions, thereby imparting a much higher degree of molecular orientation to the continuous filament than that obtained by pneumatic drawing methods.

It is well known in the art that mechanical drawing of freshly-spun synthetic filaments with draw rolls produce more uniform tensile properties from spinneret to spinneret. Until the instant invention, the molecular orientation of filaments with the use of draw rolls has not been coupled with the spinning operation in such a manner that would permit a substantially parallel laydown of filaments; that is, a web having the appearance of woven cloth on a collector in a controlled manner in a single rapid and continuous operation. The biggest obstacle to this process is that mechanical drawing of filaments with draw rolls necessitates tension on the filaments leaving the last draw roll to strip the filaments from the roll and to prevent slippage of the filaments on the draw roll. Until the instant invention, the tension was provided by various types of jet devices, which are subject to frequent and costly plug-ups.

SUMMARY OF THE INVENTION

In accordance with the invention, the above mentioned disadvantages are overcome by simultaneously spinning a multiple number of continuous filaments of a synthetic polymer in a curtain-like form onto at least one side of which molten melt blown fibers or filaments from a linear fiber generating apparatus are deposited and self-bonded to stabilize or fix the continuous filaments in substantially parallel or controlled alignment to form a coherent web, an drawing, to molecularly orient, the continuous filaments before, during, or after the deposition of the melt blown fibers or filaments.

It is proposed to form an integral filamentary web comprising continuous filaments and melt blown fibers or filaments in order that the various drawing, heat setting, and other processing variables can be handled in a web form rather than as individual filaments, thereby eliminating tension, stripping, and restringing problems. Broken continuous filaments are automatically picked up by adjacent molten continuous filaments, and continue along as an integral part of the web. The stabilized web is pulled from the exit draw roll by a cross lapper, cross layer, heated embossing rolls, or a conventional winder, any of these methods being capable of applying various degrees of tension to the web depending upon the nature of the final product. As shown FIG. 6, the longitudinal filaments 3' are oscillated laterally by modulating roll 89 and deposited on chill roll 93 in a relaxed, untensioned state prior to a deposition of melt blown fibers or filaments 12' which lock the longitudinal filaments in a parallel lineally oriented laydown pattern. However, the preferred method is to process the web including the cross lapping and cross laying steps with the longitudinal filaments under tension and molecularly oriented to the desired degree. If the filaments are elastomeric and under tension they will be in the stretched state. If the filaments are a mixture of elastomeric and drawable polymeric filaments, the elastomeric filaments will be under tension and stretched, and the drawable polymeric filaments will be under tension with the polymer molecules oriented in the direction of the filament axis. After stabilizing with melt blown fibers and upon relaxing, the elastic filaments contract and the web shortens in the direction of the elastic filament contraction, thereby forming buckles and curls or kinks in the non-elastic molecularly oriented permanently lengthened continuous filaments. The forming of a stabilized web by the deposition of melt blown fibers allows the array of individual filaments to be further processed as an integral web, obviating the need for aspirators, eductive devices such as eductive guns, noneductive devices, and including the application of static high voltage to filament groups. The handling of a multitude of continuous filaments, having a predetermined controlled alignment, as an integral web during the various finishing operations eliminates the previously stated problems, such as turbulence problems, filament intertwining, plugging of eductors by broken filaments, and nonuniform basis weight opacity, and porosity. The laydown patterns of the continuous filament alignments across the web are in a substantially predetermined controlled alignment, thereby providing the web with a controlled predetermined porosity, opacity, and a uniform basis weight throughout the web. The basis weigh of the melt blown web or fibers may be as low as about 3 to 5% of the final web basis weight and has a negligent effect on the opacity, porosity, and basis weight of the web.

In actual practice random laid webs rarely, if ever, reach complete randomness, and as a result are not completely uniform in appearance. This non-uniformity detracts from its suitability as filters, medical fabrics, and the like, which require a low degree of variations in porosity, basis weight, and opacity. Since aspirators, eductors, non-eductive arrangements, and the like do not precisely control the laydown patterns of individual filaments in predetermined controlled laydown alignments, the final web is subject to the aforementioned variables.

In one embodiment, the melt blown fibers are deposited in a molten state onto the curtain of partially coagulated and partially drawn continuous filaments immediately upon exiting from the spinneret and subsequently drawn again according to predetermined conditions.

In another embodiment, the drawable melt blown fibers or filaments are deposited and self-bonded to the curtain of continuous filaments after the continuous filaments have been partially drawn upon exiting from the spinneret, cooled to the solid state, and subsequently drawn according to predetermined conditions.

In another embodiment, the molten melt blown fibers or filaments are deposited onto the curtain of continuous filaments after they have been fully drawn either pneumatically or mechanically, and in another embodiment the melt blown fibers and/or filaments are deposited on the continuous filaments as they are being drawn, as will be subsequently discussed in more detail. Alternately, previously manufactured fibers may be deposited on a curtain of molten continuous filaments from an air former wherein, upon deposition, fusion bonds or self bonds are formed at the intersections of the air blown fibers and the molten continuous filaments. These air blown fibers may include both natural and manmade fibers of all types, including wood pulp, cotton, hemp, rayon, sisal, and drawn or undrawn textile fibers.

In an alternate arrangement, streams of melt blown fibers are merged with streams of cellulose fibers and/or super absorbent polymeric particles prior to deposition on the stabilized web to form a high bulk highly absorbent fabric.

In another modification, it is proposed to roughen the surface of the feed and draw rolls. This roughened and non-cling surface allows continuous filament slippage on at least a portion of the feed and draw roll surfaces during the drawing and orienting of the continuous filaments. In order to obtain continuous filaments of very high draw ratios, it is necessary to heat the continuous filaments during drawing. By having the feed roll temperature below the temperature of sudden crystallization and stickiness of the continuous filaments, the continuous filaments are partially drawn and oriented at the lower temperatures of the feed roll which allows a slipping on a portion of its surface, and the filaments are gradually drawn along the way to the draw roll, which has a substantially higher temperature than the feed roll, whereon more slippage takes place and the drawing is completed with a high total draw ratio.

The temperature at which the continuous filaments become sticky depends on the speed with which the continuous filaments are heated; that is, the faster the heat-up for the continuous filaments, the lower will be the temperature at which they suddenly start to crystallize and become sticky for a short period of time. A slow build-up of heat raises the continuous filament crystalinity and in turn the softening temperature causing stickiness.

The thermoplastic melt blown fibers or filaments used herein for stabilizing a curtain of continuous filaments can be prepared by known techniques as described in an article by Van A. Wente entitled "Superfine Thermoplastic Fibers" appearing in *Industrial and Engineering Chemistry,* Vol. 48, No. 8, pp. 1342 to 1346. The fiber diameters may vary from 0.5 to 50 or more microns depending upon the combination of gas flow rates, polymer flow rate, die temperature and polymer molecular weight. Their lengths may vary from short fibers to substantially continuous length filaments depending upon the air temperature and velocity and the distance from the die to the collector.

The terms "melt blown fibers," "melt blown filaments," and "melt blown fibers and/or filaments" are herein used interchangeably. The term "continuous filament" as used herein refers to the melt spun filaments formed from a number of orifices in a spinneret plate and are continuous. The terms "continuous filament" and "melt spun filaments" are herein used interchangeably.

Among the many thermoplastic polymers suitable for use in stabilizing the above filament curtain are polyolefins such as polypropylene, polyethylene, polybutane, polymethyldentene, ethylenepropylene copolymers; polyesters such as polyhexamethylene adipamide, poly-(oc-caproamide), polyhexamthylene sebacamide; polyvinyls such as polystyrene; thermoplastic elastomers such as polyurethanes; other thermoplastic polymers such as polytrifluorochloroethylene and mixtures thereof; as well as mixtures of these thermoplastic polymers and copolymers; also included are viscoelastic hot melt pressure sensitive adhesives such as "Fullastic" supplied by H. B. Fuller and Co., and other hot melt adhesives including pressure sensitive adhesives. Any of the fiber forming thermoplastic polymers including fiber forming hot melt adhesives, pressure sensitive adhesive, and viscoelastic hot melt pressure sensitive adhesives can be used for stabilizing the web or bonding the tabilized web to one or more cellulose webs, wood pulp webs, melt blown fibrous mats, or for laminating and bonding two or more stabilized webs to form laminates. The instant invention is not limited by the above polymers, for any thermoplastic polymer, copolymer, or mixture thereof capable of being melt blown into fibers or filaments is suitable. Any of the thermoplastic elastomers which are capable of being melt blown or melt spun is suitable for the manufacture of stretchable fabrics.

The continuous filaments used herein to form a curtain of continuous filaments can be of many materials, natural or manmade, ranging from textile threads or yarns composed of cotton, rayon, hemp, etc. to thermoplastic polymers. This invention is not limited to the use of any particular fiber, but can take advantage of many properties of different fibers. A curtain of continuous filaments or threads using multifilament threads of rayon or nylon is readily stabilized by depositing a layer of molten melt blown fibers or filaments on this continuous filamentary web. Upon cooling, the molten melt blown filaments become tacky and self-bond to the continuous rayon or nylon threads.

In the preferred embodiments, thermoplastic melt spun continuous filaments are used which involve continuously extruding a thermoplastic polymer through a spinneret thereby forming a curtain of individual filaments. Among the many thermoplastic polymers suitable for the continuous filaments are polyolefins such as polyethylene and polypropylene; polyamides; polyesters such as polyethylene terepthalate; thermoplastic elastomers such as polyurethanes; thermoplastic copolymers; mixtures of thermoplastic polymers; copolymers and mixtures of copolymers; as well as the previously listed materials used herein for the melt blown fibers and filaments. However, the present invention is not limited to these materials for any melt spinnable polymer is suitable, including various tar products obtained from or produced as by-products from fossil fuels that are spinnable into carbon fibers. Other spinnable thermoplastic elastomers which are suitable for stretchable fabrics are polyester based polyurethane; and polyester type polyurethane polymeric fiber forming elastomers such as Texin 480A supplied by Mobay Chemical Company, but not limited to these.

Another object of the present invention is to provide a method or process for the manufacture of non-woven webs with increased strength from continuous filaments which have been molecularly oriented to a high degree under closely controlled drawing and temperature conditions and formed into a web of substantially parallel continuous filaments, and which can be used to ply up webs of two or more plies with the various webs having their filaments plied in a transverse direction to each other, the transverse angles varying from 0° to 90°. The continuous filaments of one layer may have a substantially parallel orientation in the machine or longitudinal direction with an adjacent layer having continuous filaments in substantially parallel orientation at a 90° transverse angle. However, if two layers of continuous substantially parallel filaments are biased at equal opposite transverse angles of between 0° and 90° the lasers will be mirror images of each other. Since the angle of bias may vary from layer to layer, it should be noted that mirror images are not always necessary or needed. The continuous filaments of one layer may be the same or different than the continuous filaments of another layer or the continuous filaments in a single layer may be different from one another. In some cases, the layers may be composed of 100% elastomeric filaments or the layers may be composed of a combination of continuous elastomeric filaments and continuous filaments of another drawable polymer, stabilized with melt blown elastomeric polymers.

Another object is to couple the spinning an drawing of continuous filaments with their stabilization to form a curtain of continuous filaments having a predetermined laydown orientation ranging from a substantially parallel orientation to a random orientation including curvilinear, zigzag, or various overlapping orientation, the filaments being drawn mechanically or pneumatically.

A further object is to provide for automatic restringing upon filament breakage without the problems of plug-ups and filament entanglement with the associated costly machine down time for unplugging.

Another object of the present invention is to stabilize or fix in a predetermined orientation a multiple number of continuous filaments in a curtain form by depositing a layer of melt blown filaments or fibers before, during or after drawing to molecularly orient the continuous filaments.

A further object of this invention is to create a novel web which is characterized by a lineal substantially parallel alignment of continuous filaments which imparts to the web a woven appearance coupled with a uniform opacity, drapability, soft textile-like hand and superior strength.

A more specific object is to increase immeasurably the numbers of fusing or self-bonds on the continuous filaments by depositing and fusing or self-bonding to the continuous filaments a layer of molten melt blown fibers while decreasing the density of autogenous embossed spot bonds and increasing the web tensile properties with the use of a substantially parallel filament laydown, resulting in a better hand and cloth-like appearance. Non-woven fabrics generally have not been used for clothes for the simple reason that as the strength of the fabric is increased the draping properties are decreased. The strength of the fabric can be increased by increasing the number of spot bonds or applying a large amount of bonding resin to the filamentary layer, which in turn results in inhibition of the movement of the filaments with one another, an increased resistance to deformation, and a resultant decrease of the draping properties of the fabric. Since a complete randomness is rarely accomplished in a random laid web, which can be seen by its non-uniform appearance and variability of the swirling, looping, overlapping arrangement of the filaments, especially in light weight webs, it becomes necessary to increase the number of spot bonds or compacted areas to form a coherent structure or web of commercial integrity, which in turn results in poor drapability. To overcome the increase in stiffness, many attempts have been made to soften the web by working and stretching the web in one or more directions, which have met with a limited success at an increased cost.

In the instant invention, increased strength with good drapability is obtained by providing spans between spot bonds or melt blow fiber bonds, consisting of numerous continuous, longitudinal, substantially parallel filaments which act simultaneously to absorb applied loads or forces thereby eliminating the necessity for larger densities or numbers of spot bonds or compacted areas which in turn decreases the draping qualities of the fabric. In a web consisting of two or more face to face layers of continuous, substantially parallel and straight filaments lying transversely to each other, the load or transmitted force is distributed among several continuous filaments in a relatively straight line through bond points or compacted areas. In prior art random laid webs, the filaments are deposited in a looping, swirling, and overlapping fashion, wherein the tension force is applied to curved and looped filaments, between the spot bonds or compacted areas, and the filaments are bonded to each other obliquely in the compacted areas where the filaments are deformed and weakest. As a result of the looping and swirling laydown there are few, if any, straight filaments between widely spaced or low density bond points with the result that the load is applied to the filaments, one at a time rather than simultaneously as in the instant invention, and wherein the first filament to be loaded receives the greatest stress. In addition, the oblique tensions on the compacted areas of prior webs further increase the stress. See FIG. 19, which shows a representative portion of a random laid conventional non-woven web 301 having closely space autogenous bonds 303 having spans consisting of substantially random laid filaments 305. To form a coherent web the bond spacings have to be decreased thereby increasing the total compacted area of the web, and decreasing the ability of the filaments 305 to slide and move with respect to one another during web deformation, all of which decreases the drapable properties of the web 301.

Woven fabrics having no bonds at their continuous filament intersections have increased drapability and are more conformable than non-woven webs having like filaments with bonds at their intersection. When these woven fabrics are deformed or draped about an object, the continuous filaments slip and slide at their intersections since the said intersections are not bonded, and as a result have increased drapability. Conventional random laid continuous filament non-woven webs have no coherency or strength unless they are bonded in some form or manner with a resultant increase in stiffness and decrease in drapability.

The primary object of the present invention is to provide a non-woven web and a method or process for making said non-woven web comprised of continuous substantially parallel filaments which approach more closely a supple, flexible woven web having no bonds at their filament intersections, than has heretofore bee possible with prior art methods. It is also an object to provide the said web with bonded continuous filament widely spaced and variable intersections intermingled with non-bonded continuous filament intersections in various proportions to provide said web with various degrees of suppleness. These bonds may consist of autogenous spot bonds, using heat and pressure, or any other suitable form of bonding.

The forming of substantially parallel continuous filament non-woven webs having no bonds at the continuous filament intersections or various combinations of bonded intersections combined with intersections having no bonds, which allow the said continuous filaments to slide or creep over one another as they do in woven fabrics, facilitates the ability to produce and substitute lower cost non-oven webs for the more expensive woven webs in an increasing number of markets. The continuous filament spacings may vary from wide spaces between filaments to webs wherein the continuous parallel filaments are so dense they touch one another.

The parallel continuous filaments need not be bonded to each other at their intersection, but, rather may be stabilized in a web form by a deposition of fusion bonded smaller diameter melt blown fibers, having a lower tensile strength, on one or both sides of the continuous filament curtain. These smaller lower tensile strength fibers are fusion bonded intermittently along the lengths of the continuous filaments, or alternately, melt blown fibers of a lower fusion temperature than said continuous filaments may be deposited on both sides of said continuous filamentary curtain resulting in the melt blown fibers fusing to themselves only, since their fusion temperature is too low to fuse with the continuous filaments, thereby trapping or constraining the continuous filaments in a parallel filamentary arrangement.

This filamentary web may now be further processed by cross lapping or cross laying into webs having no bonds at intersections of the continuous filaments, or may be bonded at least at some of the continuous filament intersections with the use of heat and pressure spot bonding, or other forms of intermittent bonding. This additional bonding increases the fabric strength and facilitates the lamination of various assemblies of webs. The bond patterns and their spacing may be such that there is a minimum of or no deleterious effect on the web or fabric suppleness.

In the case wherein the parallel non-woven filaments are connected to each other by fusion bonded smaller diameter melt blown fibers which allow the said continuous filaments to slide over one another at their intersections when the web is deformed, the finer, weaker, low molecularly oriented fibers bend, move, or when elongated undergo molecular orientation with relatively low forces when said web is deformed. If elastomeric fibers are used stretching takes place upon web deformation.

In cases where stiffer more rigid webs or fabrics are required, they may be obtained by bonding a majority or all of the continuous filament intersections in a heated calender stack having at least two rolls, at least one of which is heated and temperature controlled. One such laminate consists of at least two non-random arrays of continuous filaments, at least one of which is stabilized with a deposition of melt blown fibers, the arrays being positioned in laminar face-to-face relationship and separated by at least one deposition of melt blown fibers and passed through the laminator and laminated together so that the longitudinal filaments of one array is transverse to the filaments of the other array. If the melt blown fiber deposition layer is dense with no voids or apertures, the continuous filaments will be bonded predominantly at or near their intersection areas. As the melt blown fiber deposition layer becomes predominantly apertured less and less of the continuous filaments and their intersections are bonded.

Various hot melt adhesives and elastomeric materials may be used as the melt blown fiber deposition layer, and as the hot melt adhesive melting points are reduced the calender roll temperatures are reduced accordingly. If pressure sensitive adhesives are used for the melt blown fiber deposition layer, the calendering may be done at room temperature and at a reduced calender roll pressure.

Cover stock fabrics useful for sanitary napkins and diapers having a high number of open areas for quick strike through or transmission of body fluids including viscous mucous associated with menstrual flow are obtained by widely spacing the continuous filaments and depositing an extremely light weight open mesh fibrous melt blown layer prior to calendering fabric.

The melt blown fiber deposition layer preferably has a lower melting point or range than the continuous filaments and upon passing through the heated calender rolls soften and fuse or adhere to the continuous filaments. The melt blown fibers may be adhesives or composed of the same polymers as the continuous filaments with no additives and act as an adhesive by adhering to the continuous filament upon the application of heat and pressure. The bonding may be accomplished by passing the various webs through bonding rolls, both of which are smooth as an alternate to the previously discussed spot bonding rolls.

Another object of the present invention is to provide a method or process and the apparatus for producing non-woven webs that range in weights and uses from light weight non-wovens weighing from about 3 to 60 grams per square meter used in disposable products to the heavy weight geotextile fabrics weighing from 60 to 2,000 grams per square meter, and that do not require the highly capital intensive investment of prior art methods and apparatus.

Another object of the invention is to provide a non-woven web wherein energy absorbing characteristics are obtained through additional drawing for molecular orientation of the melt blown fibers which are bonded to themselves and to the molecularly drawn continuous filaments thereby distorting the web when under strain rather than having filament breakage accompanied with web tearing.

Another object is to provide a web of continuous molecularly oriented filaments containing a predetermined number of continuous filament crossings.

Another object is to provide a web of continuous molecularly oriented filaments having a non-random predetermined laydown or orientation pattern.

Another object is to provide a coherent elastic web of predetermined continuous filament crossings and laydown patterns which is stretchable in one or more directions.

Other features and advantages of the invention will become clear to those skilled in the art upon reading the detailed description.

BRIEF DESCRIPTION OF THE DRAWINGS

FIG. 6 is a perspective view of apparatus for producing a patterned parallel orientation to the continuous filaments of a web;

Figure 1:
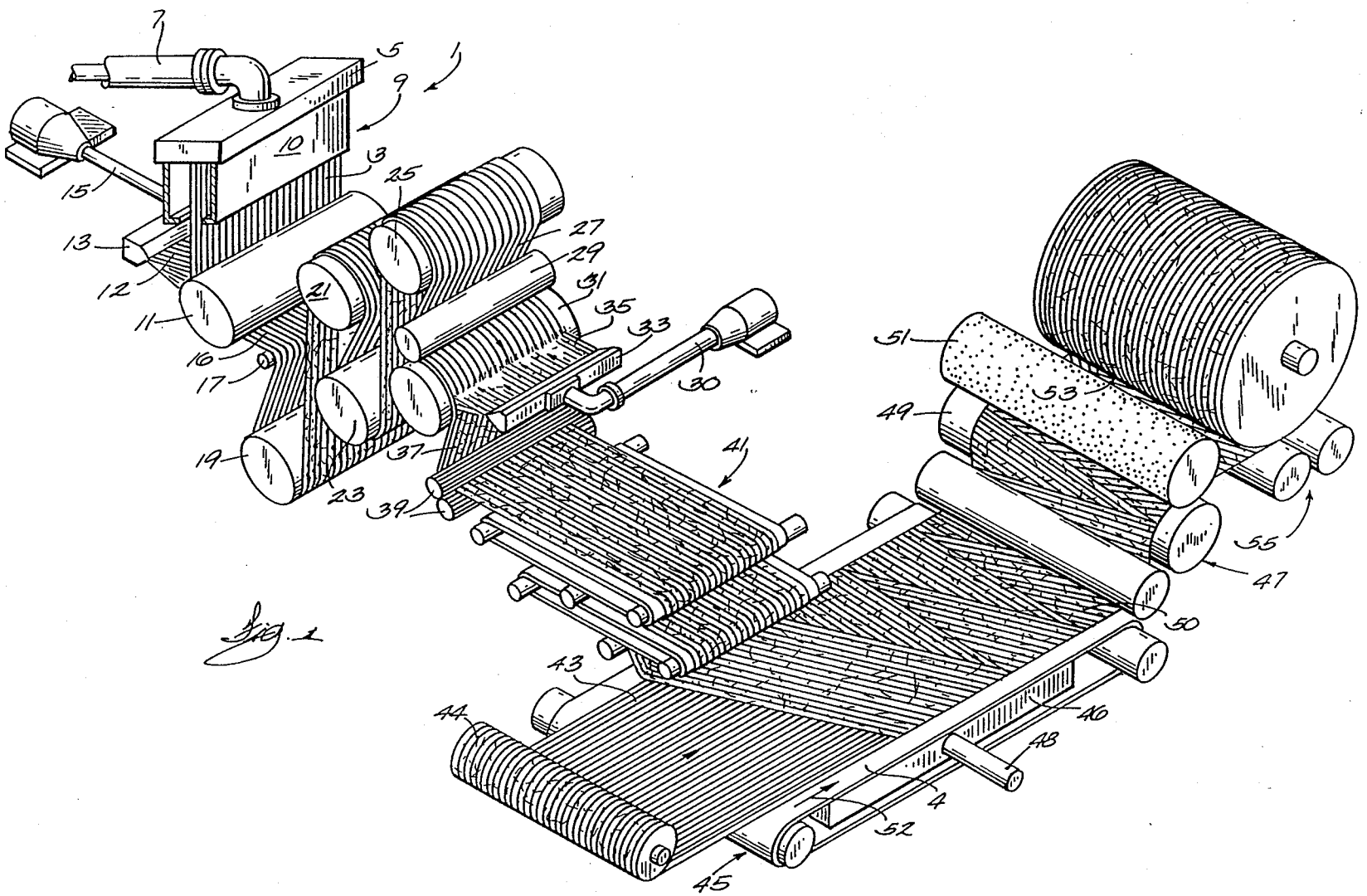
FIG. 1 is a perspective view of apparatus for manufacturing a non-woven web according to the present invention.
Figure 8:
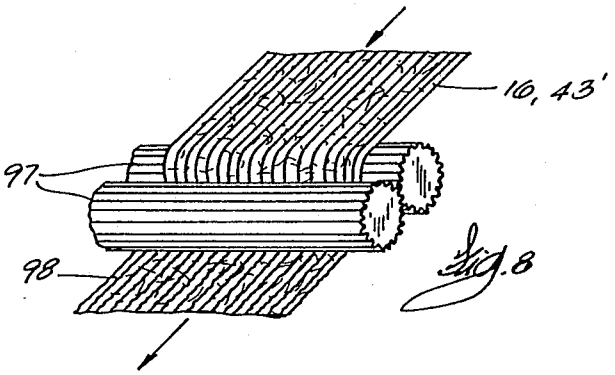
Figure 21A:
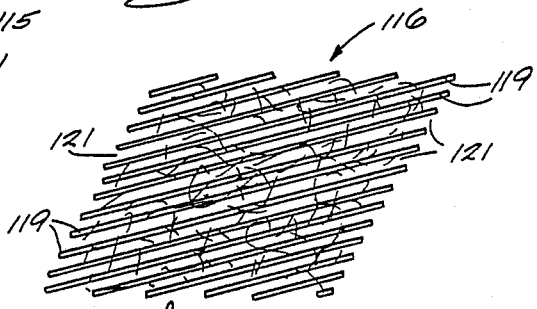
Figure 14:
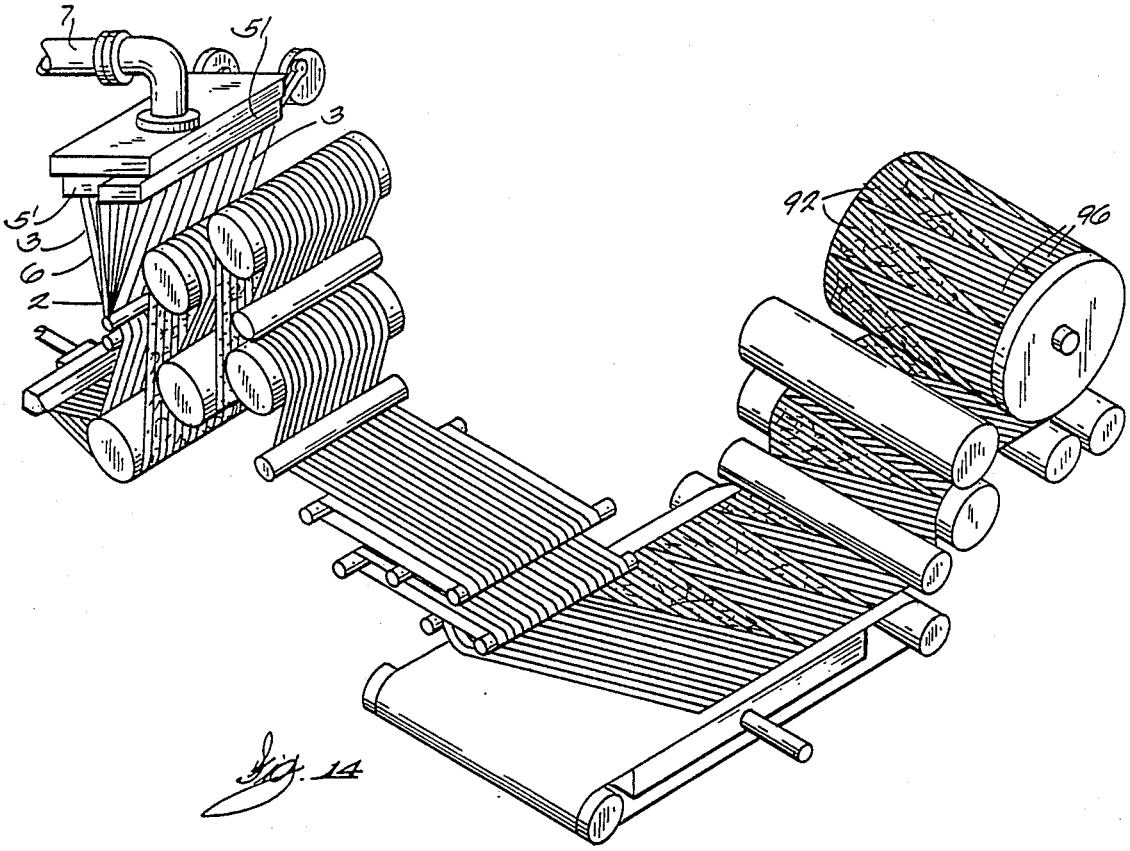
Figure 15:
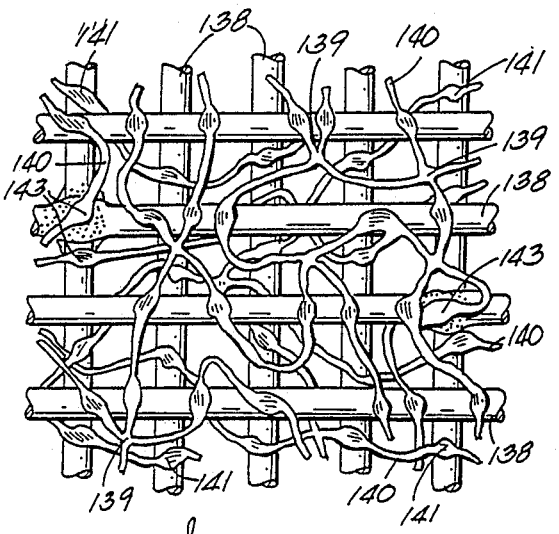
Figure 16:
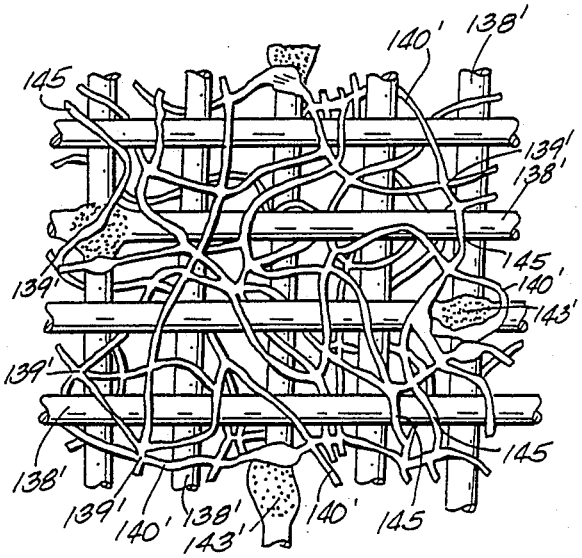

FIGS. *7a* and *7b* are perspective views of modified patterned webs produced by apparatus similar to that shown in FIG. 6;

FIG. 8 is a perspective view of apparatus for incrementally drawing a web of continuous filaments and melt blown fibers;

FIGS. 9 and 10 are schematic views of the deposition of melt blown fibers on continuous filaments;

FIGS. 11*a*, 11*b*, 11*c*, 12*a*, 12*b*, 12*c*, 13*a*, 13*b* and 13*c* are perspective views of various combinations of webs manufactured according to the present invention;

FIG. 14 is a perspective view similar to FIG. 1, but showing dual oscillating spinnerets;

FIGS. 15 and 16 are magnified views of typical areas of bonded fibers and filaments formed into webs according to the present invention;

FIG. 17 is a magnified view of a web having spaced apart autogenous bonds with spans of two layers of substantially parallel continuous filaments;

FIG. 18 is a magnified view of a web having spaced apart autogenous bonds with spans of one layer of substantially parallel continuous filaments;

FIG. 19 is a magnified view of a prior art web having closely spaced autogenous bonds with spans consisting of substantially random laid filaments;

FIG. 20 is a magnified view of a web according to the present invention wherein a portion of the continuous filaments are contracted but remain under a light tension;

FIG. 21 is a magnified view of a web portion between emboss points; and

FIG. 22 is a view similar to FIG. 21, but showing displacement of a typical filament when the web is used.

DETAILED DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

FIG. 1 is a perspective view of apparatus 1 for manufacturing the present invention and showing a large number of continuous monofilaments 3 that are melt-spun from a corresponding number of extrusion orifices in a spinneret 5. The extrusion orifices are arranged in an elongated rectangular arrangement, in one or more rows, or in one of many other configurations. The spinneret 5 is fed a fused polymer from a first extruder 7.

The spinnerets may be arranged so that two or more spinnerets 5' oscillate as shown in FIG. 14. If two spinnerets 5' are 180° out of phase, the resultant web will consist of two layers of continuous filaments, each in a parallel sinusoidal patterned orientation, 180° out of phase with each other. If the filaments are closely spaced and have a sufficient oscillation amplitude, the molten filaments will overlap one another and form bonds at their cross over points. Alternately, the various spinnerets may be fed different polymers. In the construction of FIG. 14, the filaments 3 from the individual spinnerets 5' travel in zone 6 under ambient conditions. By the time the individual curtains of filaments come together at region 2, they have become solidified.

In FIG. 1, the filaments 3 are drawn mechanically from the spinneret and enter a travel zone 9, which may be confined inside a covered chamber or chimney 10 so as to introduce cooled, ambient, or heated air or other gas at a controlled temperature as required for draw processing or at least partially solidifying the filaments. The extruded filaments travel to a temperature controlled accumulating roll 11 whereon a layer of melt blown fibers or filaments 12 is deposited and fused or self-bonded to the continuous melt spun filaments 3 by a first melt blown die 13 being fed a fused polymer from a second extruder 15. Alternately, a conventional fiber blowing device or air former, not shown, may be used to deposit either natural or manmade fibers of all types, including drawn or undrawn textile fibers. This fiber deposition may range in weight from less than one gram per square meter to several hundred grams per square meter. The stabilized web 16 passes over the guide device 17 and around the first feed roll 19, around the first draw roll 21, around the second draw roll 23, and finally around the third draw roll 25. The feed roll 19 and draw rolls 21, 23, and 25 are temperature controlled in order to meet all the conditions necessary for hot or cold drawing, heat setting, or annealing the filaments for high strength or other preferred properties and may have smooth or rough surfaces depending on how much slip is required for processing. The filaments need not be fully drawn, for it may be desirable to have some potential molecular orientation remain in the filaments so that in use or under load the filaments will stretch and be additionally drawn and molecularly oriented rather than exceed the elongation to break and rupture. The stabilized and drawn web 27 passes around idler roll 29 and onto chill roll 31, at which time a second melt blown die 33 being fed a second fused polymer from a suitable extruder 30, usually of a different melting point or range, deposits a second layer 35 of melt blown fibers on the stabilized web. If required, the web 37 passes through a pair of crimping or stretch rollers 9, which impart an incremental stretch and crimp to the web, thereby increasing the draw and bulk of the melt blown fibers 12 and 35 and the continuous filaments 3. This process is further described and illustrated in U.S. Pat. No. 4,153,664, which is incorporated herein by reference. The drawn bulked and stabilized web 37 is deposited on a conventional cross lapping apparatus 41, as more fully described in U.S. Pat. No. 3,183,557, which is also incorporated herein by reference, and cross lapped onto web 43 which is supplied from a parent roll 44 and is carried downstream by conveyor 45 on a non-stick foraminous conveyor belt 4. A conventional vacuum chamber 46 underlies the conveyor. The vacuum chamber 46 is connected to a vacuum supply via a duct 48. The continuous filaments of the cross lapped web 37 are now lying on web 43 in transverse directions to the conveyor travel, as indicated by arrow 52. The transverse angle may vary from 0° through 90°. The two webs 37 and 43, shown as composite web 50, are carried into heated embosser 47 of which one roll 49 is smooth. The upper embosser roll 51 contains a plurality of raised points that autogenously bond the cross lapped web 37 and the longitudinal web 43 together to form a single high strength, drapable web 53 containing a pattern of spot bonds. The pattern of autogenous bonds need not be symmetrical. Autogenous bonds are produced by the application of heat and pressure alone without any application of solvents or adhesives, whereas melt blown pressure sensitive adhesive fibers are able to form bonds with each other or to other fibers and filaments with only the use of pressure. The autogenous bonds may range from fusion bonds t stick or release bonds which retain filament identity upon separating or releasing under strain, and may extend through the web, thereby fusing all fibers and filaments in the bond area or may form fusion bonds with the fibers or filaments on the outer surface or surfaces.

Since the spans between bonds contain substantially parallel filaments in a substantially controlled predetermined laydown alignment, the total numbers of spot bonds or total spot bond area between webs 37 and 43 can be reduced, with no reduction in web strength since the substantially parallel laydown is more uniform and stronger. This reduction in spot bonds reduces web stiffness, creating a more flexible web with increased hand and drapability. The raised points on the heated upper roll 51 may follow the construction disclosed in U.S. Pat. No. 4,041,203.

Alternately, the cross laid or cross lapped longitudinal filaments may be bonded to each other or to other webs with melt blown fibers and/or filaments of hot melt adhesive fibers, pressure sensitive adhesive fibers, or viscoelastic hot melt pressure sensitive adhesive fibers, or a fine spray of ambient temperature liquid adhesives.

In another modification, one or more plies, mats, or layers of melt blown superfine thermoplastic fibers such as those described in "Industrial and Engineering Chemistry" may be laminated to one or more stabilized webs by passing the ply assembly through the heated embossing rolls 47. The stabilized webs may consist of only one web of stabilized longitudinal filaments or may consist of several layers, including cross lapped and/or cross laid webs. FIG. 17 shows a representative portion of a web 146 having spaced apart autogenous bonds 147 having spans therebetween consisting of two layers of substantially parallel or non-random laid filaments 148. FIG. 18 shows a representative portion of a web 156 having spaced apart autogenous bonds 157 having spans therebetween consisting of one layer of substantially parallel or non-random laid filaments 158. The plies, mats, or layers of melt blown superfine thermoplastic fibers preferably have fiber diameters in the range of about 0.5 to 10 microns or depending upon the product being manufactured may be larger than 10 microns in diameter. One or more microfiber mats may be combined with one or more layers of stabilized webs and cross lapped or cross laid to produce fabrics for use as surgical gowns, drapes, and the like having excellent strength and drape or flexibility characteristics. Since the stabilized web is composed of continuous filaments in a substantially predetermined non-random lineal orientation with a controlled predetermined porosity, opacity, and uniformity of basis weight across the web, it is especially suitable for products requiring air permeability and liquid strike through resistance or water repellent characteristics such as surgical overwraps, sterile wraps, or containment fabrics for surgical or health care procedures. The stabilized web and the melt blown mats may be laminated by the deposition of melt blown fibers comprised of hot melt adhesives on either the mat or the web. The hot melt adhesives may also be of the pressure sensitive type or may be a viscoelastic hot melt pressure sensitive adhesive.

Alternately, the cross lapped continuous filament web 37 and the continuous longitudinal filament web 43 laminate may be passed between two heated belts under pressure, thereby holding the web 50 under positive restraint to prevent shrinkage, and heat bonded. After bonding, the web 53 is wound on a conventional winder 55, FIG. 1.

Optionally, adhesive may be applied to web 43 by means such as roller coating or spraying prior to cross lapping to facilitate the lamination of web 53 to one or more plies of cellulosic tissue or melt blown microfiber mat. Melt blown hot melt adhesive fibers can be deposited on the continuous filaments before, during, or after cross lapping or cross laying. The melt blown adhesive fibers can be of the hot melt type, pressure sensitive type, or an of the adhesives capable of being spun into fibers.

Figure 2:
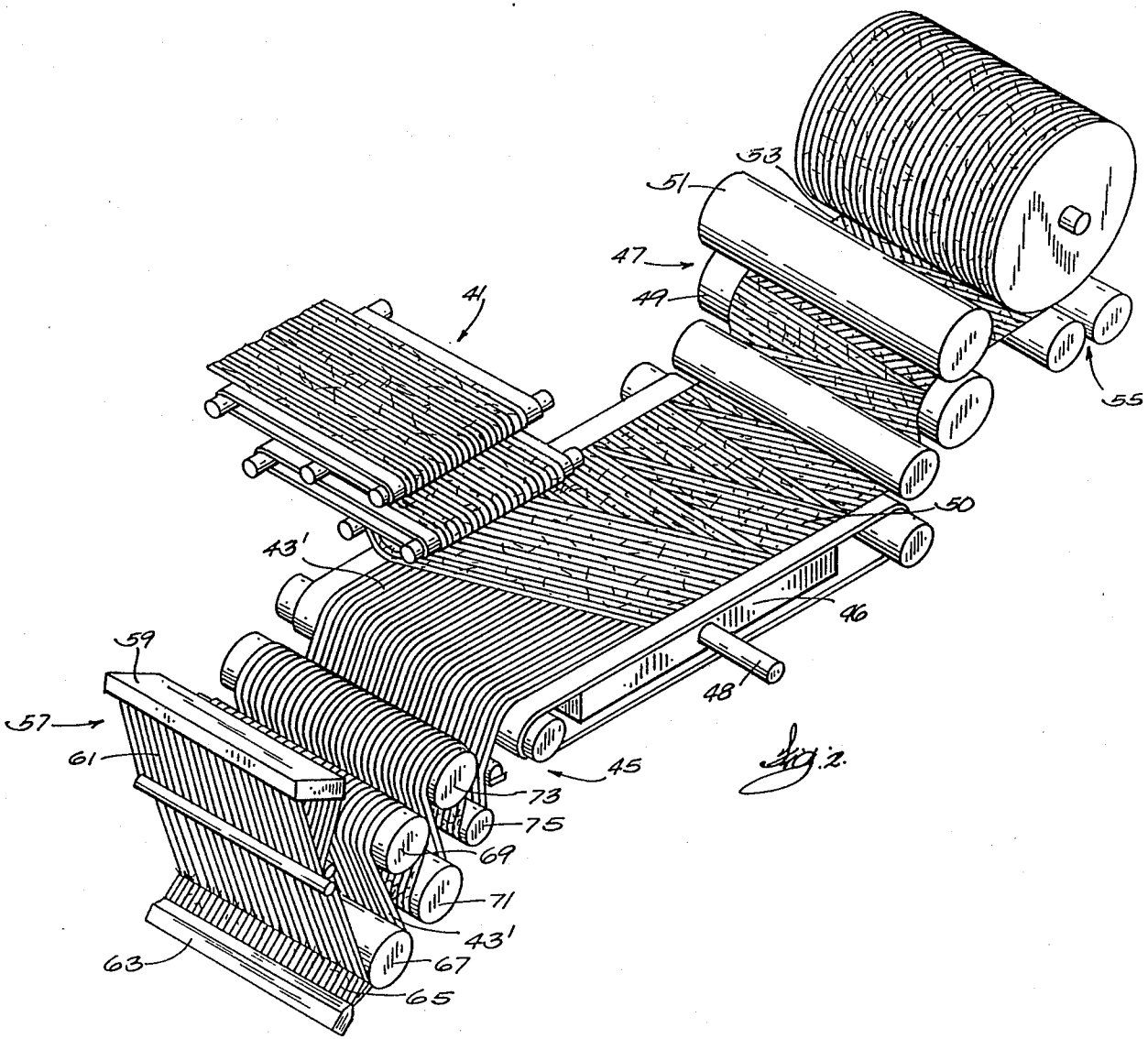
FIG. 2 is a perspective view of a portion of the apparatus for manufacturing a non-woven web according to the present invention and showing a second unit for directly depositing a first web on a conveyor unit prior to lamination with a second web.

Referring to FIG. 2, apparatus 57 is illustrated that directly supplies a web 43' to the conveyor 45 for cross lapping. The apparatus 57 comprises a spinneret 59 that is fed by an extruder, not shown. Filaments 61 are drawn from the spinneret 59 in curtain form. A die 63 continuously deposits melt blown fibers 65 on the curtain of filaments 61 to create the stabilized web 43'. The stabilized web 43' passes over feed roll 67, draw rolls 69, 71, 73, 75, and finally passes onto the conveyor 45.

Figures 3, 4:
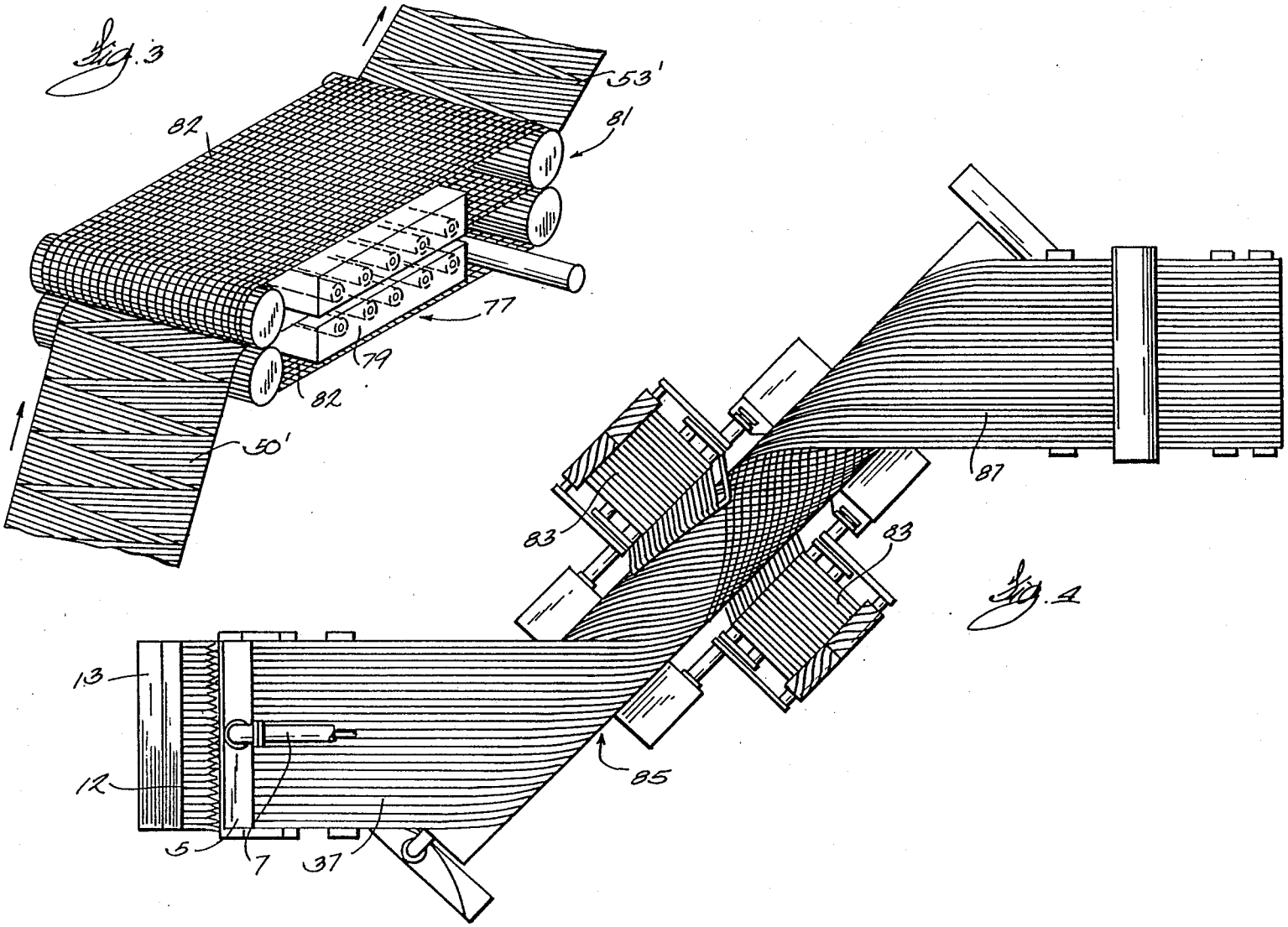
FIG. 3 is a perspective view of alternate apparatus for bonding cross laid webs.
FIG. 4 is a top view of cross layer apparatus for laying filaments of two webs at 90° to each other.

Turning to FIG. 3, alternate apparatus 77 is depicted for bonding cross laid webs. In FIG. 3, reference numeral 50' refers to the unbonded cross laid web of continuous substantially parallel filaments of polyamides and blends thereof, including melt blown polyamide fibers or filaments self-bonded to the continuous polyamide filaments. As they leave the conveyor 45 of FIGS. 1 or 2, the webs 50 or 50' may pas through an activating gas chamber 79 as taught in U.S. Pat. No. 3,516,900 by a conveyor system 81. The individual webs are self-bonded between two porous constraining belts 82 under heat and pressure by using the gaseous material to activate the bonding properties of the polymeric filaments and create the single high strength web 53'.

Figure 5:
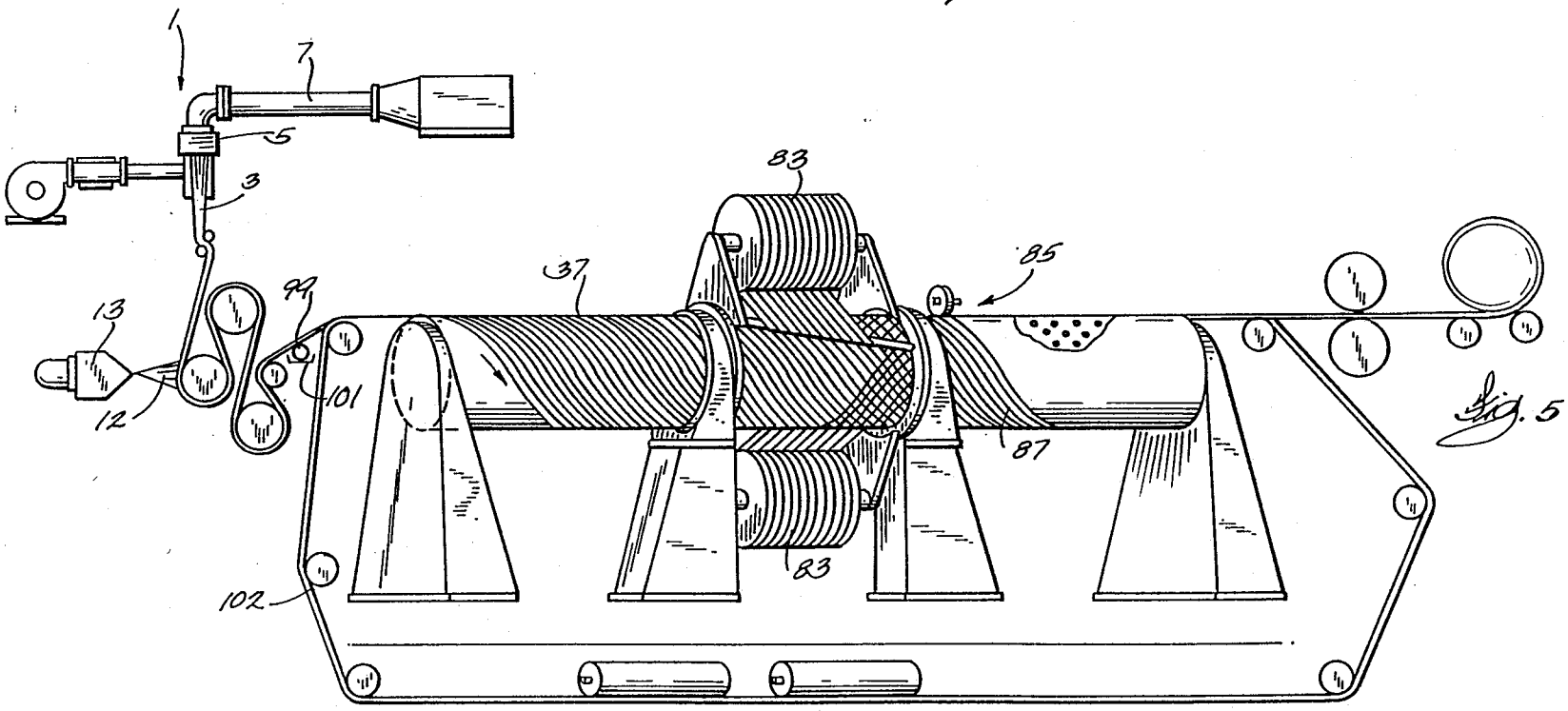
FIG. 5 is a side view of the cross layer apparatus of FIG. 4.

If it is desired that the continuous filaments intersect each other at 90°, rolls of stabilized continuous filament webs 83 are mounted on a cross layer 85 as shown in FIG. 4 and FIG. 5 and as disclosed in U.S. Pat. No. 3,492,185, the disclosure of which is incorporated herein by reference. In FIG. 5, reference numerals 99 represent adhesive applicator rolls, and reference numerals 101 represent adhesive pans, both of which are well known in the art. A non-stick belt is shown at 102. The resultant web is illustrated at reference numeral 87.

In FIG. 14, it will be noticed how the melt blown fibers lie after the cross lapping operation. The melt blown fibers ar alternately above and under the cross lapped web. In web portions 92, the melt blown fibers are on the exterior and the continuous filaments are in face to face relationship. In web portions 96, the melt blown filaments are in face to face relationship.

After drawing, the filaments may be heat set on one or more draw rolls by heating the filaments at substantially constant length to impart dimensional stability thereto. They also may be cold stretched at substantially ambient temperatures or above but not exceeding about 100° C. for polypropylene, followed by hot stretching at a temperature above about 120° C., but below the fusion temperature, without allowing shrinkage of any significant degree to their cold stretched length. In addition to heat setting under relaxed or tensile conditions, differential drawing, crimped or incremental drawing, and mechanical drawing using draw rolls with variable surface temperatures and surface roughness variations from smooth to rough may be performed.

In the embodiment shown in FIG. 6, one or more modulating rolls 89 are used prior to a melt blown deposition of fibers or filaments 12' on the curtain of filaments 3'. In FIG. 6, reference numeral 93 indicates a chill roll. The modulating rolls 89 reciprocate in transverse directions, as indicated by arrow 91, to place the parallel lineally oriented filaments in a patterned parallel orientation or in a patterned overlapping orientation.

The terms "parallel," "approximately parallel," and "substantially parallel" are herein used interchangeably and are intended to describe the alignment patterns of continuous filaments within the practical limits of machine lay down on a roll or belt in a substantially parallel alignment with each other. This alignment may be in a curvilinear sinusoidal, zig zag, or other pattern and may be in one or more layers of overlapping patterns. The resulting web 94 is thus composed of generally longitudinally extending sinusoidal patterned continuous filaments 3' and the melt blown fibers 12'. These patterns can zigzag in linear or curvilinear orientation. A typical portion of the resulting web 95 is shown in FIG. *7a*. If desired, two oppositely reciprocating modulating rolls can be used in a manner that produces double sinusoidal patterns that are out of phase. In that case, the web takes on the general appearance shown at 95' in FIG. *7b*. The web can be incrementally drawn with minimum distortion to the continuous filament orientation.

Referring to FIG. 8, a pair of corrugated draw rolls 97 may be used to incrementally draw the composite we 16 or 43' of the melt spun partially drawn continuous filaments and melt blown substantially undrawn stabilizing fibers. The incremental drawing causes minimum distortion to the filament orientation and creates a stabilized web 98 of a drawn filamentary curtain and fibers.

Returning to FIG. 1, it is preferred that a fiber-forming thermoplastic polymeric resin is extruded in molten form through orifices of heated nozzles of the die 13 at temperatures within the range of about 250°-900° F. into a stream of hot inert gas at temperatures of about 250°-1000° F. to attenuate the molten resin as fibers or filaments 12, which are then deposited in a molten form onto a curtain of molecularly oriented continuous filaments 3 having a low degree of crystalinity, forming self-bonds at their intersections or crossover points. Hot melt adhesives including pressure sensitive hot melts can be melt blown using air temperatures as low as about 250° F. The various parameters for self-bonding with a minimum of increased crystalinity in the continuous filaments are the distance from the melt blown nozzles to the continuous filamentary curtain, the deposition temperature of the melt blown fibers or filaments at the instant of contact with the continuous filaments, the diameters of the melt blown fibers or filaments as compared to the diameters of the molecularly oriented continuous filaments, and the time the continuous filaments are subjected to the fusing self-bonding temperatures. Under-bonding results in early filament release under strain, while over-bonding can result in increased filament crystalinity resulting in filament degradation with an accompanying reduction in filament tenacity. With a die nozzle and gas temperature in the range of 580°-650°, melt blown polypropylene fibers or filaments having diameters of about 3 to 12 microns were satisfactorily self-bonded to drawn molecularly oriented continuous polypropylene filaments having diameters ranging from about 50 to 100 microns, at a die-to-curtain distance of 6 inches to 10 inches under ambient conditions. This die-to-curtain distance can be varied to accommodate various combinations of melt blown fiber and filament diameters in conjunction with various continuous filament diameters, the various melt blown fiber deposition temperatures, and the variations in the ambient air cooling or quenching conditions at the die nozzle exit in the quench chamber 10.

The close control of these parameters assures that the temperatures of the surfaces to be fusion bonded are rapidly raised to the continuous filament softening point or range before significant amount of crystalinity in the continuous filaments 3 has taken place. A rapid heat-up rate results in the fusion bonding temperature being reached before the polymer in the continuous filament has an opportunity to substantially increase in crystalinity and hence fusion bonding can be achieved at a lower temperature. The faster the heat-up rate the lower will be the bonding temperature required for satisfactory autogenous, fusion, or elf-bonding, thereby allowing the self-bonding to take place under less difficult bonding conditions. This rapid heat build-up followed with a rapid chilling by chill roll 11 at the bond surface has a negligible effect on continuous filament crystalinity of filament sizes shown in FIG. 9, wherein the diameter of the continuous filaments 3 is approximately 40 to 50 microns and the diameter of the melt blown fibers or filaments 12 is approximately 6 to 20 microns. A slow build-up of heat to fusion temperatures raises the continuous filament crystalinity and in turn the softening temperatures, thus requiring difficult bonding conditions to bring about surface filament-to-fiber fusion. A rapid chilling of the molten melt blown fibers or filaments solidifies the polymer in a preponderantly amorphous state with very little molecular orientation. These fibers or filaments can be molecularly oriented by drawing incrementally or otherwise in one or more directions. If the continuous molecularly oriented filaments have been subject to too high a temperature at the bonding intersections, they lose their molecular orientation in the bond area. This over-bonding, with its accompanying excessive fusion, adversely affects the web tensile characteristics and usually occurs when the melt blown molten fibers or filaments 12 are large as compared to the molecularly oriented continuous filaments 3 in the curtain. This can be seen in FIG. 10 wherein the continuous filament diameters are approximately 10 to 12 microns and the hot molten melt blown fiber or filament diameters are approximately 40 to 50 microns. This overheating of the continuous filaments 3 in the bond region reduces the molecular orientation in these areas and the stabilized filamentary curtain requires another draw to reorient the continuous filaments at the bonded cross-over points. This later condition of excessively high temperatures can be overcome by varying the temperature of the air introduced via duct 99 into a quenching camber 101 and the distance of the melt blowing spinneret 13 to the chill roll 11.

In another embodiment, the continuous filament curtain is stabilized with a deposition of melt blown molten fibers or filaments of a second polymer which may or may not be compatible with the polymer of the continuous filaments; that is, having the ability to form fusion or melt bonds with the continuous filaments without continuous filament degradation at bond intersections. The melt blown fibers are deposited on the continuous filaments supported by a temperature controlled accumulating roll which prevents the continuous filaments from becoming overheated. Also, the distance from the melt blown spinneret to the temperature controlled accumulating roll can be varied so that the temperature of the melt blown fibers or filaments can b kept such that the increase in crystalinity in the continuous filaments will not be high enough to adversely affect the continuous filament tenacity, even though the surface of the continuous filament is softened to the tacky state. The temperature controlled accumulator may be a roll, belt, or a stationary bar depending upon the tackiness of the emerging polymer, and may be foraminous depending upon the volume of high velocity air needing to be dispersed. Even if the polymers are incompatible, they form releasable bonds which are strong enough to give the stabilized filamentary curtain enough integrity to carry it through the downstream drawing and bonding operations, even though some of the bonds release under strain. The use of different polymers in the melt spun continuous filaments and the melt blown fibers or filaments facilitates the laminating and bonding of two or more layers of the stabilized double polymer filamentary web. By using a polymer which after the degradation by the melt blown deposition has a lower softening or melting point tan the continuous filaments, the attaching of the two webs can be accomplished by fusion bonding the melt blown fibers or filaments with each other without raising the temperature of the continuous filaments to the softening point herein an increase in filament crystalinity has an adverse effect on the web tenacity. This two-polymer filamentary web can now be cross lapped and laminated as in FIG. 1 and FIG. 2 or may be cross laid as previously described and shown in FIG. 4 and FIG. 5. Also, the cross lapped or cross laid webs can be laminated to one or more plies of cellulosic tissue or to one or more plies or mats of super fine melt blown micro-fibers having diameters in the range of about 0.5 to 10 microns with the use of melt blown adhesives such as hot melts, pressure sensitive hot melts, or viscoelastic hot melt pressure sensitive adhesives. The melt blown fiber diameters may be larger than 10 microns depending upon product requirements, and the laminating adhesives are not limited to melt blown fibers. It is preferred that about three percent or more of any of the stabilizing melt blown fibers re self bonded at the junctions with each other or with the continuous filaments.

In another embodiment, molten melt blown fibers or filaments 12 are deposited on freshly spun continuous filaments 3 as they are being drawn. That process forms an improved bond since a fresh new surface is exposed by drawing. Molten melt blown dissimilar polymers and incompatible polymers form release or stick bonds strong enough to withstand downstream laminating operations. These melt blown polymers may have melting points or ranges above or below the melting point or the melting range of the continuous filaments, which serves to increase the number of bonds in plied bonded webs, as in FIGS. 11 to 13, when autogenously bonded by a pair of heated rolls, one of which has raised points on its surface as previously described and shown in FIG. 1.

Figure 11A:
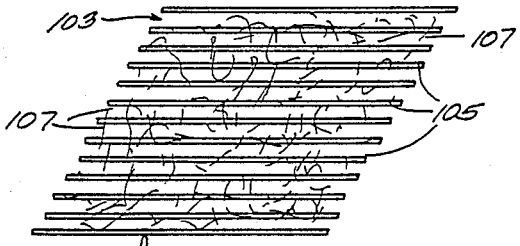
Figure 11B:
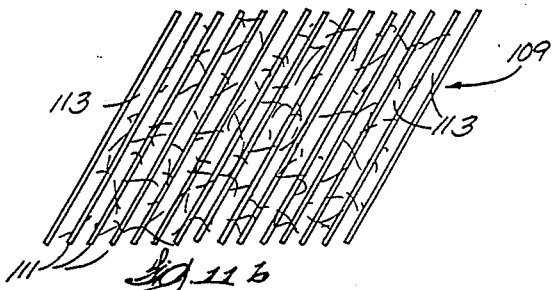
Figure 11C:
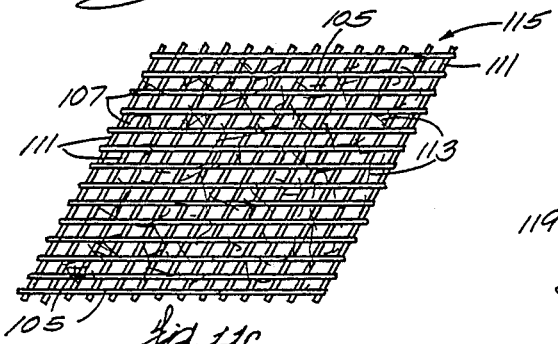

In FIGS. 11*a*–11*c*, FIG. 11*a* show a first web 103 of stabilized continuous filaments 105 to which are bonded the melt blown fibers 107. In FIG. 11*b*, a second web 109 is comprised of the continuous filaments 111 and melt blown fibers 113. The webs 103 and 109 are oriented such that the filaments 105 are placed at right angles to the filaments 111. The two webs are placed together such that the continuous filaments 105 and 111 are in facing contact. Bonding the individual webs results in the composite web 115 of FIG. 11*c*, which comprises two curtains of stabilized continuous filaments bonded together at 90° to each other in face-to-face relationship.

Figure 12B:
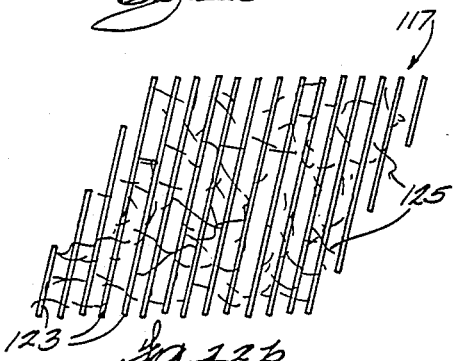
Figure 12C:
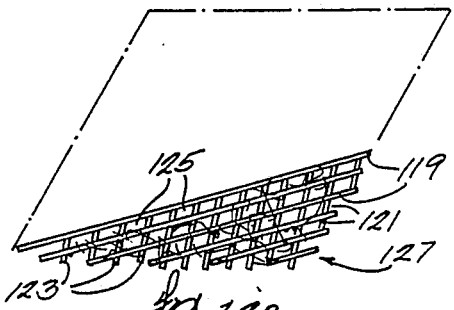

FIGS. 12*a* and 12*b* show webs 116 and 117, respectively. Web 116 is composed of continuous filaments 119 stabilized by fibers 121, and web 117 is composed of continuous filaments 123 stabilized by fibers 125. The filaments 119 and 123 are positioned transversely to each other at an angle of less than 90°, with the filaments 119 and 123 in facing contact. The two webs 116 and 117 are then bonded together such that the melt blown filaments are in facing contact to create the two-ply web 127 of FIG. 12*c*. The assembly of these webs may be accomplished in one of three ways as follows: 1) the stabilized continuous filaments of a first web being in face-to-face relationship with the continuous filaments of a second stabilized web; (2) the melt blown fibers of a first stabilized web being in face-to-face relationship with the melt blown fibers of a second stabilized web; (3) the melt blown fibers of a first stabilized web being in face-to-face relationship with a filamentary curtain composed of continuous filaments of a second stabilized web.

Figure 13A:
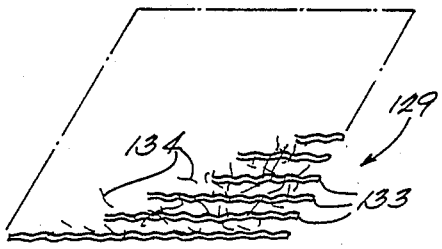
Figure 13B:
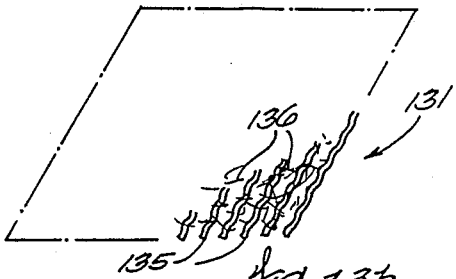
Figure 13C:
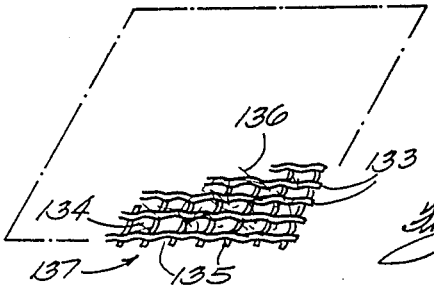

In FIG. 13*a*, reference numeral 129 refers to a web of continuous filaments 133, stabilized by fibers 134, that have been incrementally drawn. Web 131 of FIG. 13*b* is composed of incrementally drawn filaments 135 that are stabilized by fibers 136. The filaments 135 are transversely positioned at 90° to the filaments 133 of web 129. Bonding the filaments 133 and 155 of the webs 129 and 131, respectively, to each other in face-to-face relationship at 90° results in the exceptionally high bulk two-ply web 137 of FIG. 13*c*.

As shown in FIG. 1, molten melt blown fibers 35 may be deposited on cooled molecularly oriented continuous filaments 3 that are partially wrapped around a chill roll 31. The melt blown fibers are cooled or quenched rapidly in a relatively undrawn state with low tenacity. Upon drawing through a pair of crimp rollers 39, the melt blown fibers become oriented in various degrees with increased tenacity as described in U.S. Pat. No. 4,153,664 discussed earlier. When the drawn continuous filaments are put under strain, such as by the wearer of a diaper, the melt blown fibers are further drawn to shift the strain onto joining filaments. This drawing continues until the strain is absorbed by the adjacent filaments and the web has exhibited considerable elongation by the extenuation of the melt blown fibers. In contrast, if the melt blown fibers were undrawable, they would break when the developed stress exceeded their tenacity, thereby increasing the strain on the continuous filaments, which after reaching the breaking point would have reduced effective lengths over which they could carry an applied strain. This property of the melt blown fibers to attenuate under load or strain enhances the softness, drapability, surface smoothness, and fabric like feel necessary for light weight fabrics used in disposable products, and shifts or distributes the strain over a large number of continuous filaments.

In another embodiment, molecularly oriented continuous filaments in combination with stretched elastomeric continuous filaments are subjected to a deposition of molten melt blown polymers and kept under tension until the self bonding melt blown fibers and/or filaments have solidified, thereby stabilizing the web in a stretched and drawn condition. Upon relaxing, the elastic filaments contract, and the web shortens in the direction of elastic filament contraction. This contraction forms buckles or wavy curls or kinks in the substantially parallel, non-random, moleculary oriented continuous filaments between the foreshortened bond spacings. In some cases where the proportion of molecularly orientable filaments to elastomeric filaments is high, the elastomeric filaments do not relax completely but remain under a minimal or low tension after having contracted enough to form curls, kinks or buckles in the molecularly oriented filaments. FIG. 20 depicts a representative portion of a stabilized web 150 of the present invention showing the continuous elastic filaments 151 that have contracted somewhat, but that still are under a light tension, together with non-elastic molecularly oriented continuous filaments 153. The web 150 is stabilized by the melt blown filaments 155. The curls or buckles vary in shape and size depending on the placement of the elastomeric filaments and the proportions of elastomeric filaments to the molecularly oriented filaments 153. When two or more plies of the curled and buckled webs 150 are bonded together, a resultant laminate or fabric is obtained which has a very high bulk and is very light in weight. Its high bulk makes it very useful for disposable garments because of its increased opacity. The melt blown fibers and/or filaments may be either a molecularly orientable polymer, a stretchable elastomeric polymer, or a melt blown polymeric adhesive.

In another embodiment, elastomeric continuous filaments are stretched and kept under tension while depositions of melt blown elastomers or other spinnable polymers are deposited in face-to-face relationship, thereby producing stretchable webs of variable restretch characteristics.

In another embodiment, a curtain of continuous filaments of a higher melting temperature than the melt blown fibers is locked in place or constrained in a predetermined orientation, with a deposition of elf-bonding melt blown fibers on each side of the curtain, which are fusion-bonded or self-bonded. The bonding of melt blown fibers to the continuous filaments vary from no bonds to stick bonds. The melt blown fibers form bonds with each other varying from fusion bonds to releasable bonds yet are able to constrain and hold the continuous filaments in predetermined alignment until processed into the final web. Melt blown webs as low as 2 to 4 grams per square meter have satisfactorily locked and held continuous filaments in place during various processing procedures. However, the preferred melt blown fiber basis weight for stabilizing an array of filaments is in the range of about 5 to 10 grams per square meter with no limit on the maximum basis weight of melt blown fibers deposited on heavier basis weight webs. Since the melt blown fiber stabilizing deposition has a very low basis weight with respect to the filamentary array, slight variations in its random laydown deposition have little if any effect on the porosity, opacity, and uniformity of the basis weight across the final web.

The terms "fusion-bonding" or "self-bonding" are used herein interchangeably, and are brought about by molten surface filament-to-fiber fusion. The terms "releasable bonds" and "stick bonds" are used herein interchangeably and are fusion or autogenous bonds of a temperature low enough to allow filaments to separate or pull free from each other without breaking, or bonds between incompatible materials, which, due to their chemical structures or their variances in melting points or ranges, form weak, stick, or releasable bonds. The terms "drawn" and "molecularly oriented" are used herein interchangeably.

FIG. 15 is a magnified view of continuous filaments 138 locked in place by fusion bonds of the melt blown fibers 140 to each other at points 139 and by fusion bonding of the melt blown filaments to the continuous filaments at 141. The continuous filament 138 are shown autogenously bonded to other continuous filaments and to melt blown fibers at points 143.

In FIG. 16, a magnified view of continuous filaments 138' locked in place between fusion bonded melt blown fibers 140' is presented. The continuous filaments 138' are constrained in substantially parallel or substantially non-random orientation. The continuous filaments are locked in place by fusion bonding of melt blown fibers 140' to each other at points 139'. Autogenous bonding occurs at typical points 143'. In addition, some stick or released bonds, or no bonds with the continuous filaments, occur at points typified at reference numeral 145.

Further in accordance with the present invention, non-woven webs are provided that possess the conformability and drapability of woven fabrics made from the same filaments. Like woven fabrics, the non-woven web is comprised of continuous filaments having no bonds at their intersections. Accordingly, as with woven fabrics, the continuous filaments of the non-woven web are free to slide and slip relative to each other when the web is deformed or draped over an object.

Turning to FIGS. 21 and 22, a magnified portion of a non-woven web 311 having substantially parallel cross laid continuous filaments 313 and 315 is illustrated. The continuous filaments 313 and 315 are stabilized to form the web 311 by means of small diameter melt blown fibers 317. The melt blown fibers 317 are fusion bonded intermittently to the continuous filaments along the lengths thereof, as at points 319, on one side of the continuous filaments. Alternately, the melt blown fibers may be deposited on and fusion bonded to both sides of the continuous filaments. If desired, melt blown fibers having a lower fusion temperature than that of the continuous filaments may be deposited on both sides of the continuous filaments. Consequently, the melt blown fibers fuse only to themselves, and they trap the continuous filaments in a parallel arrangement. In FIG. 21, the web 311 is in a relaxed condition. When the web is deformed by use, the continuous filaments slide over one another, as shown in FIG. 22. For example, in FIG. 22 typical continuous filament **315*b* is shown in a location displaced from the location 315*a* of FIG. 21 due to deformation of the web. Relative movement of the continuous filaments 315 causes associated movement of the weaker melt blown fibers 317. For example, the melt blown fibers typically represented at 323*a* in FIG. 21 become stretched to the respective conditions represented by reference numerals 323*b* in FIG. 22. Other melt blown fibers, such as fibers 325*a* in FIG. 21, become relaxed to the condition represented by reference numeral 325*b* in FIG. 22**. If the melt blown fibers are of a drawable polymer, they will become molecularly oriented upon stretching when the web is deformed.

The present invention is based on the discovery that stabilization of molecularly oriented continuous filaments having laydown patterns ranging from substantially parallel orientations to random orientation including predetermined curvilinear, zigzag, or various overlapping orientations with melt blown molten drawable fibers forms an integral web which, when subjected to overloading, strains deforms and stretches by the additional drawing or molecular orienting of the partially oriented melt blown fibers, thereby shifting the overloading strain over a larger number of continuous filaments rather than rupturing the web. The stabilized molecularly oriented continuous filament web is processed by cross lapping, cross laying, or laid-up in two or more plies which are then subjected to a spot bonding operation by passing it through two heated rolls, one of which has a plurality of projections on its surface, the shape of which may be square, rectangular, round or some similar shape. The web, subjected to heat and pressure of the embossing rolls, has formed on it discrete compacted areas of sizes and shapes determined by those of the roll projections, wherein the fibers and filaments have been autogenously bonded together U.S. Pat. Nos. 3,855,045; 3,855,046; and 4,100,319, which are incorporated herein by reference, teach that the bond density should be about 100–500 compacted areas per square inch with polymer filaments having deniers of about 0.8–2.5 and bond densities of about 50–3,200 compacted areas per square inch with polymer filaments having deniers of about 0.5–10, with total bonded areas of about 10–25% and about 5–50%, respectively. It has been found that the higher the number of compacted areas per unit area in a web, and the higher the percentage of compacted area, the stiffer the web will be, with deleterious effect on drapability, softness, and clothlike feel and appearance.

By self-bonding the molecularly oriented continuous filaments in a non-random predetermined substantially parallel orientation with melt blown fibers and autogenously bonding the stabilized web in a discrete discontinuous pattern and providing spans between autogenous bonds containing non-random or substantially parallel continuous filaments, fewer compacted areas per square inch are required to form a web of commercial integrity. The non-random substantially parallel orientation with fewer compacted autogenous bonding areas significantly increases the drapability and clothlike feel and decreases the stiffness with no loss of strength during use.

The term "non-random" as used herein refers to the laydown patterns of filament alignments which are in a substantially predetermined alignment and have a substantially controlled basis weight and opacity, as opposed to the random laid filaments previously described. Previous laydown methods do not have precise control of filament laydown and positioning. These patterns may be many and various and in different layers throughout the web. The predetermined alignments may be wavy, zig zag, or sinusoidal, and various layers may cross and overlap one another. Since the random laid melt blown fibers represent a much smaller proportion of the total web weight, they have little or no noticeable effect on the overall basis weight or web opacity. Satisfactory webs have been produced having random laid melt blown stabilizing fibers with basis weights as low as 1 to 3 grams per square meter.

The most important factors which account for the improvement in strength and load or strain absorption capabilities in addition to improved drapability with clothlike feel are:

1. A substantially parallel laydown in the collector, in contrast to a random laid web, which results in improved tenacity due to improved draing conditions.

2. The ability of the melt blown fibers to attenuate or stretch under load thereby allowing the continuous filaments to shift and distribute the strain over a larger number of filaments throughout the web.

3. The increase in tenacity of the melt blown fibers as they are molecularly oriented under strain.

4. An inherently more uniform web with a substantially controlled basis weight distribution across the web.

5. The increase in uniformity of the autogenous spot bonded areas due to the uniformity of the basis weight across the web.

6. The enormous increase in continuous filament bonds due to the self-bonding of the melt blown fibers at their intersections with the continuous filaments.

7. A uniform laydown of the continuous filaments greatly enhances an improves the discrete autogenous bonding areas of light weight webs.

I claim:

1. A non-woven web comprising a multiplicity of substantially longitudinal molecularly oriented continuous filaments of a thermoplastic polymer, and a multiplicity of melt blown fibers or filaments deposited on the longitudinal continuous filaments, the melt blown fibers or filaments forming bonds at least at some of their intersections with the longitudinal continuous filaments to thereby stabilize and fix the longitudinal continuous filaments in the substantially longitudinal orientation.

2. The non-woven web of claim 1 wherein the continuous filaments are laid down in a pattern of a substantially predetermined alignment to provide the web with a controlled predetermined porosity.

3. The non-woven web of claim 1 wherein the longitudinal continuous filaments are stabilized and fixed by the melt blown fibers or filaments in a substantially parallel arrangement.

4. The non-woven web of claim 3 wherein the longitudinal continuous filaments of the parallel arrangement are wavy or curvilinear.

5. The non-woven web of claim 1 wherein the longitudinal continuous filaments cross each other at intervals along their lengths.

6. The non-woven web of claim 1 wherein the melt blown fibers or filaments are elastomeric.

7. The non-woven web of claim 1 wherein at least some of the longitudinal continuous filaments are elastomeric.

8. The non-woven web of claim 7 wherein the elastomeric filaments are under tension and the spans between the elastomeric filaments comprise rows of molecularly oriented, substantially non-random, continuous filaments having buckles, kinks, or curls.

9. The non-woven web of claim 1 wherein the longitudinal continuous filaments and melt blown fibers or filaments are elastomeric.

10. The non-woven web of claim 1 wherein the melt blown fibers or filaments are of a pressure sensitive material.

11. The non-woven web of claim 1 wherein at least some of the melt blown fibers or filaments are less than about 100 microns in diameter.

12. The non-woven web of claim 1 wherein at least some of the continuous filaments are more than 5 microns in diameter.

13. The non-woven web of claim 1 wherein the continuous filaments are molecularly oriented.

14. The non-woven web of claim 1 wherein the molecularly oriented continuous filaments cross each other at predetermined intervals along their lengths.

15. The non-woven web of claim 1 wherein the melt blown fibers or filaments are molecularly oriented.

16. The non-woven web of claim 1 wherein the web is incrementally drawn.

17. The non-woven web of claim 1 wherein a plurality of discrete areas of autogenous bonds between the longitudinal continuous filaments and the melt blown fibers or filaments are formed by heat and pressure, the areas being distributed in a discontinuous regular pattern to produce spans of self-bonded melt blown fibers or filaments and substantially parallel continuous filaments between the autogenous bonds.

18. The non-woven web of claim 17 wherein the spans between the autogenous bonds contain at least some melt blown fibers that are self-bonded at their intersections.

19. The non-woven web of claim 17 wherein the spans between the autogenous bonds contain at least some melt blown fibers bonded at their intersections with the molecularly oriented continuous filaments.

20. The non-woven web of claim 17 wherein a second layer of continuous filaments are distributed in a substantially uniform array in a transverse direction across the web.

21. The no-woven web of claim 20 wherein the transverse direction is lateral.

22. The non-woven web of claim 20 wherein the longitudinal filaments are substantially 90° to the transverse longitudinal filaments.

23. The non-woven web of claim 20 wherein the longitudinal continuous filaments of the first and second layers are under tension.

24. The non-woven web of claim 20 wherein the longitudinal continuous filaments of the first and second arrays thereof are in respective substantially predetermined alignments.

25. The non-woven web of claim 17 wherein at least some of the longitudinal continuous filaments between the autogenous bonds are self-bonded to the melt blown fibers or filaments.

26. The non-woven web of claim 17 wherein the longitudinal continuous filaments are under tension.

27. The non-woven web of claim 20 wherein the longitudinal continuous filaments of the first and second layers are cross lapped under tension.

28. The non-woven web of claim 1 wherein the longitudinal continuous filaments of the first and second arrays thereof are cross laid under tension.

29. The non-woven web of claim 20 wherein at least some of the longitudinal filaments of the first and second arrays thereof are elastomeric.

30. The non-woven web of claim 1 wherein both sides of the multiplicity of continuous molecularly oriented filaments are stabilized and fixed in a substantially longitudinal non-random array with a deposition of melt blown fibers.

31. The non-woven web of claim 1 wherein the stabilized and fixed web is one ply of a multi-ply web.

32. The non-woven web of claim 1 wherein the web is collected in a continuous and sequential series of overlapping folds or festoons.

33. The non-woven web of claim 1 further comprising an integrated mat of thermoplastic melt blown fibers united in face-to-face relationship with one surface of the web to create a laminate and to provide one surface of the laminate with a controlled predetermined porosity and basis weight.

34. The non-woven web of claim 33 wherein a second web is united to the other surface of the web to provide both sides of the laminate with surfaces having a controlled predetermined porosity.

35. The laminate of claim 34 wherein the continuous filaments of the second web are transverse to the longitudinal filaments of the first web.

36. The non-woven web of claim 1 wherein the stabilized web is folded transversely to produce overlapping folds.

37. The non-woven web of claim 36 wherein the transverse folds are irregular.

38. The non-woven web of claim 36 wherein the overlapping transverse folds are on a bias.

39. The non-woven laminate of claim 38 wherein the overlapping transverse folds are locked in place with a deposition of melt blown hot melt adhesive fibers or filaments.

40. The non-woven web of claim 38 wherein the longitudinal continuous filaments are under tension.

41. The non-wove web of claim 38 wherein the longitudinal continuous filaments are in a substantially predetermined alignment.

42. The non-woven web of claim 38 wherein the longitudinal continuous filaments are cross lapped under tension.

43. The non-woven laminate of claim 38 wherein longitudinal continuous filaments are cross laid under tension.

44. The non-woven web of claim 38 wherein at least some of the continuous longitudinal fibers are elastomeric.

45. The non-woven web of claim 36 wherein the overlapping folds are locked in place with a deposition of melt blown adhesive fibers or filaments.

46. The non-woven web of claim 1 wherein the stabilized continuous filament are in overlapping festoon layers, and wherein the overlapping festoon layers are locked in place with a deposition of melt blown fibers, or filaments.

47. The non-woven web of claim 1 wherein the stabilized continuous filaments are pleated or corrugated.

48. The non-woven web of claim 47 wherein the pleats or corrugations are stabilized at least on one side with a deposition of melt blown fibers.

49. The non-woven web of claim 1 wherein the longitudinal continuous filaments and the melt blown fibers or filaments are bonded together with a temperature controlled activating gas when in an activating gas chamber while the web is under dimensional restraint.

50. The non-woven web of claim 1 wherein the melt fibers or filaments are composed of a material selected from the group consisting of hot melt adhesives, pressure sensitive adhesives, and pressure sensitive elastomeric adhesives.

51. The non-woven web of claim 1 wherein at least about three percent of the bonds between the melt blown fibers and the continuous filaments are fusion bonds, and wherein the melt blown fibers are self-bonded with at least about three percent of the melt blown fiber self-bonds being fusion bonds.

52. The non-woven web of claim 1 wherein at least some of the bonds between the melt blown fibers or filaments with the continuous filaments and at least some of the melt blown fiber or filament self bonds are adhesion bonds.

53. The non-woven web of claim 1 wherein the longitudinal continuous filaments are in a substantially predetermined alignment.

54. The non-woven web of claim 1 wherein the longitudinal continuous filaments are cross lapped under tension.

55. The non-woven web of claim 1 wherein the longitudinal continuous filaments are cross laid under tension.

56. The non-woven web of claim 1 wherein at least some of the longitudinal continuous filaments are elastomeric.

57. A laminate comprising first and second plies of a multiplicity of molecularly oriented continuous filaments of a thermoplastic polymer, the filaments of at least one ply being stabilized in a substantially longitudinal non-random array with at least one face to face deposition of melt blown fibers, the melt blown fibers being self-bonded at least at some of their intersections with the continuous filaments, the first and second plies being bonded together transversely at a plurality of discrete areas or points of autogenous bonds, the discrete areas being distributed in a discontinuous regular pattern that provides spans between tee autogenous bonds that contain continuous molecularly oriented filaments having a substantially non-random orientation.

58. The laminate of claim 57 wherein the continuous filaments are laid down in a substantially predetermined alignment to provide the web with substantially controlled predetermined basis weight porosity, an opacity, and wherein at least some of the continuous filament cross over points are unbonded.

59. The laminate of claim 57 wherein the spans between autogenous bonds contain two or more transverse layers of continuous molecularly oriented filaments of a substantially non-random orientation.

60. The laminate of claim 57 wherein the plies are separated by at least one deposition of melt blown adhesive fibers and bonded predominantly at or near the continuous filament intersections.

61. The laminate of claim 60 wherein the melt blown adhesive fibers are pressure sensitive.

62. The laminate of claim 60 wherein the melt blown adhesive fibers are of a viscoelastic hot melt pressure sensitive adhesive.

63. The laminate of claim 57 wherein at least one array of stabilized continuous filaments are pleated or corrugated and wherein the pleats or corrugations are stabilized at least one side with a deposition of melt blown fibers.

64. The laminate of claim 57 wherein at least some of the longitudinal filaments are elastomeric and under tension.

65. The laminate of claim 64 wherein the spans between the autogenous bonds comprise buckled, curly and wavy molecularly oriented filaments.

66. The laminate of claim 64 wherein at least some of the melt blown fibers are elastomeric.

67. The laminate of claim 57 wherein the melt blown fibers are composed of a material selected from the group consisting of hot melt adhesives, pressure sensitive adhesives, and pressure sensitive elastomeric adhesives.

68. The laminate of claim 57 wherein at least about three percent of the bonds between the melt blown fibers with the continuous filaments and the self bonds of the melt blown fibers are fusion bonds.

69. The laminate of claim 57 wherein at least some of the bonds between the melt blown fibers with the continuous filaments and at least some of the melt blown fibers self bonds are adhesion bonds.

70. A non-woven laminate comprising an integrated mat of thermoplastic melt blown fibers and at least one web comprised of at least two non-random arrays of longitudinal molecularly oriented continuous filaments of a thermoplastic polymer, each array being stabilized with a deposition of melt blown fibers, the arrays being positioned in laminar face to face relationship and united together so that the longitudinal filaments of at least one array is transverse to the longitudinal filaments of at least one other array, the laydown patterns of the longitudinal filaments having a substantially non-random predetermined alignment and a substantially controlled predetermined porosity, basis weight and opacity, said web being positioned on one side of said mat in laminate face to face relationship and united together to provide a unitary structure and to integrate the stabilized web to provide the mat on at least one side with a web having a controlled predetermined porosity.

71. The non-woven laminate of claim 70 wherein a second melt blown stabilized web of at least two transverse arrays of longitudinal molecularly oriented continuous thermoplastic filaments are joined together and united with the mat on the other side thereof to provide both surfaces of said mat with a web having a substantially controlled predetermined porosity.

72. The non-woven laminate of claim 70 wherein the mat and web are united together autogenously at intermittent discrete bond areas with heat and pressure, and wherein at least some of the continuous filament cross over intersections are unbonded.

73. The non-woven laminate of claim 70 wherein the mat and web are united together with a deposition of hot melt adhesive fibers.

74. The non-woven laminate of claim 73 wherein the hot melt adhesive fibers are pressure sensitive.

75. The non-woven laminate of claim 70 wherein mat is comprised of one or more plies of cellulosic tissue.

76. The non-woven laminate of claim 75 wherein the laminate is treated with a surfactant.

77. The non-woven laminate of claim 75 wherein the longitudinal continuous filaments of the two arrays thereof are under tension.

78. The non-woven laminate of claim 75 wherein the longitudinal continuous filaments are in a substantially predetermined alignment.

79. The non-woven laminate of claim 75 wherein the longitudinal continuous filaments are cross lapped under tension.

80. The non-woven web of claim 75 wherein the longitudinal continuous filaments of the two arrays thereof are cross laid under tension.

81. The non-woven laminate of claim 75 wherein at least some of the longitudinal continuous filaments of the first and second arrays thereof are elastomeric.

82. The non-woven laminate of claim 70 wherein the mat contains cellulosic fibers.

83. The non-woven laminate of claim 82 wherein the laminate is treated with a surfactant.

84. The non-woven laminate of claim 70 wherein the mat contains super absorbent particles or fibers.

85. The non-woven laminate of claim 84 wherein the laminate is treated with a surfactant.

86. The non-woven laminate of claim 70 wherein the laminate has been treated with a surfactant.

87. The non-woven laminate of claim 86 wherein the surfactant is selected from a group consisting of ionic and non-ionic surfactants.

88. The non-woven laminate of claim 70 wherein the melt blown fibers are composed of a material selected from the group consisting of hot melt adhesives, pressure sensitive adhesives, and pressure sensitive elastomeric adhesives.

89. An integrated non-woven web comprising:

a. a first web comprising a multiplicity of continuous thermoplastic filaments stabilized and fixed in a substantially longitudinal orientation by a deposition of melt blown fibers or filaments; and b. a second web comprising a multiplicity of continuous thermoplastic filaments stabilized and fixed in a substantially longitudinal orientation transverse to the orientation of the continuous thermoplastic filaments of the first web, the second web being positioned in laminar face-to-face relationship with the first web and bonded thereto to thereby provide an integrated web with the continuous filaments of the second web lying at a transverse angle across the continuous filaments of the first web.

90. The integrated non-woven web of claim 89 wherein the continuous filaments are laid down in patterns that are in substantially controlled predetermined alignments and have a substantially predetermined controlled porosity, basis weight, and opacity.

91. The integrated non-woven web of claim 90 wherein the continuous filaments are at least partially molecularly oriented.

92. The integrated non-woven web of claim 91 wherein the melt blown fibers or filaments are at least partially molecularly oriented.

93. The integrated non-woven web of claim 91 wherein at least some of the melt blown fibers or filaments are self-bonded at their intersections with the continuous molecularly oriented filaments.

94. The integrated non-woven web of claim 91 wherein at least some of the continuous filaments and the melt blown fibers or filaments of the second web are made of an elastomeric material.

95. The integrated non-woven web of claim 90 wherein said elastomeric filaments are under tension.

96. The integrated non-woven web of claim 89 wherein the first and second webs are bonded with a deposition of melt blown hot melt polymeric fibers.

97. The integrated non-woven web of claim 89 wherein the melt blown hot melt polymeric fibers are elastomeric.

98. The integrated non-woven web of claim 89 wherein the melt blown hot melt polymeric fibers are elastomeric.

99. The integrated non-woven web of claim 89 wherein the first and second webs are autogenously bonded at a plurality of discrete spaced apart areas by the application of heat and pressure and wherein the spans between autogenous bonds comprise at least two transverse layers of non-random continuous thermoplastic filaments, and wherein at least some of the continuous filaments are not bonded or attached to each other at their cross over points.

100. The integrated non-woven web of claim 99 wherein the spans between the autogenous bonds comprise at least two transverse patterns of buckled, curly, and wavy molecularly oriented filaments.

101. The integrated non-woven web of claim 99 wherein the spans in the first web between the autogenous bonds contain substantially parallel molecularly oriented continuous fibers that lie in a laminar transverse relationship to substantially parallel molecularly oriented continuous filaments in the spans between the autogenous bonds in the second web.

102. The integrated non-woven web of claim 99 wherein the spans between the autogenous bonds contain substantially parallel continuous filaments and self-bonded melt blown fibers or filaments.

103. The integrated non-woven web of claim 102 wherein the melt blown fibers or filaments are composed of a thermoplastic elastomer.

104. The integrated non-woven web of claim 99 wherein the spans between the bonds comprise at least two transverse layers of buckled, curled, and kinked molecularly oriented continuous filaments.

105. The integrated non-woven web of claim 89 wherein the continuous filaments of the first web are in laminar contact with the continuous filaments of the second web.

106. The integrated non-woven web of claim 89 wherein the continuous filaments of the first and second webs are separated by at least one layer of melt blown fibers.

107. The integrated non-woven web of claim 89 wherein transverse angle is 90°.

108. The integrated non-woven web of claim 89 wherein the transverse angle is less than 90°.

109. The integrated non-woven web of claim 89 wherein the transverse angle is greater than 90°.

110. The integrated non-woven web of claim 89 wherein the longitudinal filaments are at least partially molecularly oriented.

111. The integrated non-woven web of claim 89 wherein at least some of the continuous filaments are elastomeric.

112. The integrated non-woven web of claim 89 wherein the melt blown fibers or filaments of the first and second webs are elastomeric.

113. The integrated non-woven web of claim 89 wherein the second web is of a different structure than the first web.

114. The integrated non-woven web of claim 89 wherein the first and second webs are autogenously bonded together with the substantially longitudinal molecularly oriented continuous thermoplastic filaments forming the outer layers of the integrated web.

115. The integrated non-woven web of claim 89 wherein the melt blown fibers or filaments are molecularly oriented.

116. The integrated non-woven web of claim 89 wherein the continuous filaments of the first and second webs are separated by at least one face-to-face deposition of melt blown fibers or filaments.

117. The integrated non-woven web of claim 89 further comprising at least one additional web of molecularly oriented continuous filaments stabilized and fixed with melt blown fibers or filaments positioned at a transverse angle to the first and second webs.

118. The integrated non-woven web of claim 117 wherein the additional web contains at least some elastomeric melt blown fibers or filaments.

119. The integrated non-woven web of claim 118 wherein the additional web contains at least some elastomeric continuous filaments.

120. The integrated non-woven web of claim 119 wherein the stabilized and fixed continuous filaments of at least one of the webs comprises the combination of continuous thermoplastic elastomeric filaments and molecularly orientable but nonelastic continuous filaments.

121. The integrated non-woven web of claim 120 wherein the continuous thermoplastic elastomeric filaments are under tension.

122. The integrated non-woven web of claim 89 wherein the melt blown fibers of filaments are composed of a material selected from the group consisting of hot melt adhesives, pressure sensitive adhesives, and pressure sensitive elastomeric adhesives. wherein the transverse angle is 90°.

123. A non-woven web comprising at least two layers of substantially parallel continuous filaments, the continuous filaments of each layer being constrained and maintained in a substantially parallel arrangement by at least one deposition of melt blown fibers, the continuous filaments of one of the layers being non-parallel with the continuous filaments of the other layer.

124. The non-woven web of claim 123 wherein the continuous filaments are laid down in patterns that are in substantially predetermined alignments to provide the web with a controlled predetermined porosity, opacity, and basis weight throughout the web, and wherein at least some of the continuous filaments slide over one another at their intersections when said web is deformed.

125. The non-woven web of claim 123 wherein at least some of the continuous filaments are composed of a thermoplastic elastomer, and wherein at least some of the continuous filaments of at least one of the layers are composed of a molecularly orientable but non-elastic material.

126. The non-woven web of claim 125 wherein the elastomeric filaments are under tension, and wherein the non-elastic filaments ar molecularly oriented.

127. The non-woven web of claim 126 wherein the continuous filaments are buckled, curled, and kinked.

128. The non-woven web of claim 127 wherein two or more plies of buckled, curled, and kinked webs are bonded together to form a light weight high bulk stretchable laminate.

129. The non-woven web of claim 123 wherein the melt blown fibers are about 0.5 to 10 microns in diameter.

130. The non-woven web of claim 123 wherein the melt blown fibers are more than about 10 microns in diameter.

131. The non-woven web of claim 123 wherein the melt blown fibers are composed of a material selected from the group consisting of hot melt adhesives, pressure sensitive adhesives, or pressure sensitive elastomeric adhesives.

132. A method of forming a non-woven fabric-like material having improved strength, cloth-like appearance, and improved drapability, said method comprising the steps of:

a. forming one or more rows of closely spaced filaments by spinning molten polymer streams;
b. directing said spun continuous filaments onto the surface of a temperature controlled accumulator;
c. directing an air stream containing melt blown molten fibers to said temperature controlled accumulator surface and onto rows of closely spaced continuous filaments to form bonds at the junctions of melt blown fibers and continuous filaments and to form bonds at the cross over points of the melt blown fibers with themselves to produce a web of stabilized longitudinal substantially parallel continuous filaments, said air stream having a temperature in the range of about 250° F. to about 900° F.;
d. drawing said stabilized web; and
e. collecting said web.

133. The method of claim 132 further comprising the step of directing an air stream containing melt blown molten fibers to said temperature controlled accumulator surface and onto rows of closely spaced continuous filaments to form bonds at the junctions of melt blown fibers and continuous filaments and to form bonds at the cross over points of the melt blown fibers with themselves to produce a web of stabilized longitudinal substantially parallel continuous filaments, said air stream having a temperature in the range of about 250° F. to 900° F., subsequent to performing the step of drawing the stabilized web.

134. The method of claim 132 wherein the step of collecting the web comprises the step of collecting the web on a cross layer or cross lapper.

135. The method of claim 134 further comprising the step of spot bond embossing the web subsequent to collecting the web on the cross lapper or cross layer.

136. The method of claim 134 further comprising the step of adding an adhesive.

137. The method of claim 136 further comprising the step of laminating one or more plies of cellulosic tissue.

138. The method of claim 136 wherein the step of adding an adhesive comprises the step of adding melt blown hot melt fibers.

139. The method of claim 138 wherein the step of adding hot blown hot melt fibers comprises the step of adding melt blown elastomeric hot melt fibers.

140. The method of claim 134 wherein the step of collecting the web on a cross layer or cross lapper comprises the step of cross lapping the web under tension.

141. The method of claim 134 wherein the step of collecting the web on a cross layer or cross lapper comprises the step of cross laying the web under tension.

142. The method of claim 135 further comprising the step of laminating one or more plies of melt blown thermoplastic fibers to the stabilized web.

143. The method of clam 135 further comprising the step of applying at least one deposition of a melt blown not melt adhesive.

144. The method of claim 143 wherein the step of applying at least one deposition of hot melt adhesive comprises the step of supplying a pressure sensitive hot melt adhesive.

145. The method of claim 144 wherein the step of applying at least one deposition of hot melt adhesive comprises the step of supplying a viscoelastic hot melt pressure sensitive adhesive.

146. The method of claim 132 wherein the step of directing said spun continuous filaments onto the surface of a temperature controlled accumulator comprises the step of oscillating one or more rows of the continuous filaments.

147. The method of claim 146 wherein the step of oscillating rows of continuous filaments comprises the step of oscillating the rows of continuous filaments to cross each other.

148. The method of claim 146 further including the step of laminating at least one ply or mat of melt blown fibers.

149. The method of claim 148 wherein the step of directing an air stream containing melt blown molten fibers comprises the step of forming melt blown fibers having diameters in the range of approximately 0.5 microns to approximately 10 microns.

150. The method of claim 148 wherein the step of directing an air stream containing melt blown molten fibers comprises the step of forming melt blown fibers having diameters greater than about ten microns.

151. The method of claim 132 wherein the step of drawing said stabilized web includes the step of incrementally drawing the web.

152. The method of claim 151 wherein the step of incrementally drawing the web is performed subsequent to the step of oscillating one or more rows of the continuous filaments.

153. The method of claim 132 wherein the step of forming rows of closely spaced filaments comprises the step of providing an elastomeric material for the filaments.

154. The method of claim 132 wherein the step of directing an air stream containing melt blown fibers comprises the step of directing the air stream containing melt blown fibers through a foraminous accumulator to thereby separate the molten fibers from the air stream.

155. The method of claim 132 wherein the step of forming rows of closely spaced filaments comprises the step of oscillating two or more rows of closely molten filaments.

156. The method of claim 132 wherein the step of directing an air stream containing melt blown molten fibers comprises the step of self bonding more than about three percent of the junctions of the melt blown fibers.

157. The method of claim 132 wherein the step of directing an air stream containing melt blown molten fibers comprises the step of self bonding at least some of the junctions between the melt blown fibers and the continuous filaments.

158. The method of claim 132 wherein the step of drawing the stabilized web comprises the step of molecularly orienting at least some of the melt blown fibers.

159. The method of claim 132 wherein the step of collecting said web comprises the step of collecting, said web in roll form.

160. The method of claim 132 wherein the step of directing an air stream containing melt blown fibers comprises the step of creating some release bonds between the melt blown fibers and continuous filaments.

161. The method of claim 132 wherein the step of directing an air stream containing melt blown molten fibers comprises the step of fusion bonding more than about three percent of the junctions of the melt blown fibers with the continuous filaments and the junction of the melt blown fibers with other melt blown fibers.

162. The method of claim 132 wherein the step of directing spun continuous filaments onto the surface of a temperature controlled accumulator comprises the step of directing the spun continuous filaments onto the surface of a temperature controlled accumulator in a predetermined substantially controlled alignment.

163. The method of claim 132 wherein the step of directing an air stream containing melt blown molten fibers onto rows of closely spaced continuous filaments to produce a web of stabilized longitudinal substantially parallel continuous filaments comprises the step of producing stabilized longitudinal substantially parallel continuous filaments in a substantially predetermined alignment.

164. The method of claim 132 wherein the step of forming bonds at the junctions of the melt blown fibers and continuous filaments and at the cross over points of the melt blown fibers with themselves comprises the step of forming stick bonds between the melt blown fibers and continuous filaments and of the melt blown fibers with themselves.

165. A method of forming a non-woven fabric-like material having improved strength, cloth-like appearance, and improved drapability, said method comprising the steps of:

a. forming one or more rows of closely spaced filaments by spinning molten polymer streams;
b. directing said spun continuous filaments onto the surface of a temperature controlled accumulator;
c. drawing said stabilized web;
d. directing an air stream containing melt blown molten fibers to said temperature controlled accumulator surface and onto rows of closely spaced continuous filaments to form bonds at the junctions of melt blown fibers and continuous filaments and to form bonds at the cross over points of the melt blown fibers with themselves to produce a web of stabilized longitudinal substantially parallel continuous filaments, said air stream having a temperature in the range of about 250° F. to about 900° F.; and
e. collecting said web.

166. A method of forming a non-woven fabric comprising the steps of:

a. forming one or more rows of closely spaced filaments by spinning molten polymer streams;
b. directing said spun continuous filaments onto the surface of a temperature controlled accumulator;
c. directing an air stream containing melt blown molten fibers to said temperature controlled accumulator surface and onto one face of the rows of closely spaced continuous filaments thereby forming bonds at least at some of the cross-over points of the melt blown fibers, thereby locking in place the continuous filaments, to produce a stabilized web of longitudinal substantially parallel continuous filaments, said air stream having a temperature in the range of about 250° F. to about 900° F.;
d. drawing said stabilized web; and
e. collecting said web.

167. The method of claim 166 further comprising the step of directing an air stream containing melt blown molten fibers to said temperature controlled accumulator surface and onto the second face of the rows of closely spaced continuous filaments thereby forming bonds at least at some of the cross-over points of the melt blown fibers, thereby locking in place the continuous filaments, to produce a stabilized web of longitudinal substantially parallel continuous filaments, said air stream having a temperature in the range of about 250° F. to about 900° F., subsequent to the step of drawing the stabilized web and prior to the step of collecting said web.

168. The method of claim 167 wherein the step of directing an air stream containing melt blown molten fibers to said temperature controlled accumulator surface and onto one face of the rows of closely spaced continuous filaments comprises the step of creating some release bonds between the melt blown fibers and continuous filaments.

169. The method of claim 166 wherein the step of collecting said web comprises the step of collecting said web on a cross layer or cross lapper.

170. The method of claim 169 further comprising the step of spot bond embossing the web subsequent to collecting the web on the cross lapper or cross winder.

171. The method of claim 170 further comprising the step of laminating and bonding at least one ply or mat of cellulosic tissue or cellulose fibers to the collected web.

172. The method of claim 170 further comprising the step of laminating and bonding at least one ply or mat of melt blown fibers to the collected web.

173. The method of claim 172 further comprising the step of laminating and bonding at least one ply or mat of melt blown fibers to the collected web.

174. The method of claim 169 wherein the step of collecting the web on a cross layer or cross lapper comprises the step of collecting the web under tension on a cross layer or cross lapper.

175. The method of claim 179 further comprising the step of adding an adhesive of melt blown adhesive fibers subsequent to the step of collecting the web on a cross lapper.

176. The method of claim 170 further comprising the step of laminating one or more plies of melt blown thermoplastic fibers to the stabilized web.

177. The method of claim 170 further comprising the step of applying at least one deposition of a melt blown not melt adhesive.

178. The method of claim 177 wherein the step of applying at least one deposition of hot melt adhesive comprises the step of supplying a pressure sensitive hot melt adhesive.

179. The method of claim 143 wherein the step of applying at least one deposition of hot melt adhesive comprises the step of supplying a viscoelastic hot melt pressure sensitive adhesive.

180. The method of claim 169 further comprising the step of adding an adhesive subsequent to the step of collecting the web on a cross lapper.

181. The method of claim 180 further comprising the step of laminating and bonding at least one ply or mat of cellulosic tissue or cellulose fibers.

182. The method of claim 169 wherein the step of collecting the web further comprises the step of applying an adhesive prior to collecting the web on a cross lapper or cross layer.

183. The method of claim 182 further comprising the step of laminating and bonding at least one ply or mat of cellulosic tissue or cellulose fibers.

184. The method of claim 182 further comprising the step of laminating and bonding at least one ply of melt blown fibers to the collected web.

185. The method of claim 166 wherein the step of forming spaced filaments comprises the step of providing an elastomeric material for the filaments.

186. The method of claim 166 wherein the step of forming rows of closely spaced filaments comprises the step of oscillating two or more rows of molten filaments.

187. The method of claim 186 wherein the step of forming rows of closely spaced filaments comprises the step of oscillating the molten filaments to cross each other.

188. The method of claim 166 wherein the step of drawing the stabilized web comprises the step of drawing at least some of the melt blown fibers.

189. The method of claim 166 wherein the step of directing an air stream containing melt blown fibers comprises the step of bonding at least three percent of the melt blown fibers to each other at their intersections.

190. The method of claim 166 wherein the step of directing an air stream containing melt blown fibers comprises the step of bonding at least about one percent of the melt blown fibers to the continuous filament at their intersections.

191. The method of claim 166 wherein the step of directing an air stream containing melt blown fibers comprises the step of directing melt blown fibers having a basis weight of more than about two grams per square meter.

192. The method of claim 166 wherein the step of directing an air stream containing melt blown molten fibers onto closely spaced continuous filaments to produce a stabilized web of longitudinal substantially parallel continuous filaments comprises the step of producing a stabilized web wherein the longitudinal filaments are in a substantially predetermined alignment.

193. The method of claim 166 wherein the step of forming bonds at the junctions of the melt blown fibers and continuous filaments and at the cross over points of the melt blown fibers with themselves comprises the stop of forming stick bonds between the melt blown fibers and continuous filaments and of the melt blown fibers with themselves.

194. A method of forming a non-woven fabric comprising the steps of:

a. forming one or more rows of closely spaced filaments by spinning molten polymer streams;
b. directing said spun continuous filaments onto the surface of a temperature controlled accumulator;
c. drawing said stabilized web;
d. directing an air stream containing melt blown molten fibers to said temperature controlled accumulator surface and onto one face of the rows of closely spaced continuous filaments, thereby forming bons at least at some of the cross-over points of the melt blown fibers, thereby locking in place the continuous filaments, to produce a stabilized web of longitudinal substantially parallel continuous filaments, said air stream having a temperature in the range of about 250° F. to about 900° F.; and
e. collecting said web.

195. A method of forming non-woven fabric comprising the steps of:

a. forming one or more rows of closely spaced continuous filaments by spinning molten polymer streams of one or more polymers;
b. drawing said continuous filaments mechanically;
c. directing a first air stream containing melt blown molten fibers onto a first side of the rows of drawn continuous filaments, thereby forming bonds at the cross over points of the melt blown fibers and locking in place the drawn continuous filaments to produce a stabilized web of longitudinal, substantially parallel, drawn, and substantially continuous filaments, said air stream having a temperature in the range of about 250° F. to about 900° F.;
d. directing a second air stream containing melt blown fibers onto the opposite side of said stabilized web, forming bonds at the cross over points of the melt blown fibers of the first and second air streams, further locking the drawn, substantially continuous filaments of the stabilized web in place, said air stream having a temperature in the range of about 250° F. to about 900° F.;
e. cross lapping said stabilized web to form a web of transversely crossing plies of drawn filaments onto a conveyor;
f. autogenously bonding the cross lapped plies together in discrete compact areas; and
g. collecting said autogenously bonded web.

196. The method of claim 195 wherein the step of collecting said autogenously bonded web comprises the step of collecting the web in the form of a roll.

197. The method of claim 195 further comprising the step of applying adhesive to the stabilized web formed by the first air stream of melt blown fibers and continuous filaments

198. The method of claim 195 further comprising the step of applying an adhesive to the stabilized web formed by the first and second air streams of melt blown fibers and continuous filaments.

199. The method of claim 195 wherein the step of forming spaced filaments comprises the step of providing an elastomeric material for the filaments.

200. The method of claim 195 wherein the step of directing a first stream containing melt blown molten fibers to produce a stabilized web of longitudinal substantially parallel drawn continuous filaments comprises the step of producing a stabilized web of longitudinal filaments that are in a substantially predetermined alignment.

201. The method of claim 195 wherein the step of directing a first air stream containing melt blown molten fibers to produce a stabilized web comprises the step of directing a first air stream containing melt blown molten fibers to produce a stabilized web under tension.

202. The method of claim 195 further comprising the step of laminating one or more plies of melt blown thermoplastic fibers to the stabilized web.

203. The method of claim 195 further comprising the step of applying at least one deposition of a melt blown hot melt adhesive.

204. The method of claim 203 wherein the step of applying at least one deposition of hot melt adhesive comprises the step of supplying a pressure sensitive hot melt adhesive.

205. The method of claim 203 wherein the step of applying at least one deposition of hot melt adhesive comprises the step of supplying a viscoelastic hot melt pressure, sensitive adhesive.

206. The method of claim 195 wherein the step of forming bonds at the junctions of the melt blown fibers and continuous filaments and at the cross over points of the melt blown fibers with themselves comprise the step of forming stick bonds between the melt blown fibers and continuous filaments and of the melt blown fibers with themselves.

207. A method of forming a non-woven fabric comprising the steps of:

a. forming one or more rows of closely spaced continuous filaments by spinning molten polymer streams;

b. directing a first air stream containing melt blown molten fibers onto a first side of the rows of drawn continuous filaments, thereby forming bonds at the cross over points of the melt blown fibers and locking in place the drawn continuous filaments to produce a stabilized web of longitudinal, substantially parallel, drawn, and substantially continuous filaments, said air stream having a temperature in the range of about 250° F. to about 900° F.;

c. drawing said continuous filaments mechanically;

d. directing a second air stream containing melt blown fibers onto the opposite side of said stabilized web, forming bonds at the cross over points of the melt blown fibers of the first and second air streams, further locking the drawn, substantially continuous filaments of the stabilized web in place, said air stream having a temperature in the range of about 250° F. to about 900° F.;

e. cross lapping said stabilized web to form a web of transversely crossing plies of drawn filaments onto a conveyor;

f. autogenously bonding the cross lapped plies together in discrete compact areas; and g. collecting said autogenously bonded web.

208. A method of forming a non-woven fabric comprising steps of:

a. forming one or more rows of closely spaced continuous filaments by spinning molten polymer streams;

b. directing a first air stream containing melt blown molten fibers onto a first side of the rows of drawn continuous filaments, thereby forming bonds at the cross over points of the melt blown fibers and locking in place the drawn continuous filaments to produce a stabilized web of longitudinal, substantially parallel, drawn, and substantially continuous filaments, said air stream having a temperature in the range of about 250° F. to about 900° F.;

c. directing a second air stream containing melt blown fibers onto the opposite side of said stabilized web, forming bonds at the cross over points of the melt blown fibers of the first and second air streams, further locking the drawn, substantially continuous filaments of the stabilized web in place, said air stream having a temperature in the range of about 250° F. to about 900° F.;

d. drawing said continuous filaments mechanically;

e. cross lapping said stabilized web to form a web of transversely crossing plies of drawn filaments onto a conveyor;

f. autogenously bonding the cross lapped plies together in discrete compact areas; and g. collecting said autogenously bonded web.

209. A method of forming a non-woven fabric comprising the steps of:

a. forming one or more rows of closely spaced continuous filaments by spinning molten polymer streams;

b. drawing said continuous filaments mechanically;

c. directing a first air stream containing melt blown molten fibers onto a first side of the rows of drawn continuous filaments, thereby forming bonds at the cross over points of the melt blown fibers and locking in place the drawn continuous filaments to produce a stabilize web of longitudinal, substantially parallel, drawn, and substantially continuous filaments, said air stream having a temperature in the range of about 250° F. to about 900° F.;

d. cross lapping said stabilized web to form a web of transversely crossing plies of drawn filaments onto a conveyor;

e. autogenously bonding the cross lapped plies together in discrete compact areas;

f. cross laying and bonding said autogenously bonded web; and g. collecting said autogenous bonded web.

210. The method of claim 209 further comprising the step of directing a stream of melt blown fibers onto the second sides of each of the first and second curtains of drawn continuous filaments prior to cross lapping the first and second stabilized webs.

211. The method of claim 210 further comprising the step of laminating and bonding cellulosic tissue to at least one of the web plies.

212. The method of claim 210 further comprising the step of laminating and bonding a melt blown polymeric fibrous web or mat to at least one of the stabilized webs of continuous filaments and melt blown fibers.

213. The method of claim 212 further comprising the step of laminating and bonding a web of melt blown polymeric fibers containing cellulosic tissue to at least one of the stabilized webs of continuous filaments and melt blown fibers.

214. The method of claim 212 further comprising the step of laminating and bonding a web of melt blown fiber containing cellulosic fibers and super absorbents to at least one or the stabilized webs of continuous filaments and melt blown fibers.

215. The method of claim 209 further comprising the step of directing a stream of melt blown fibers onto the second side of one of the first and second curtains of drawn continuous filaments prior to cross lapping the first and second stabilized webs.

216. The method of claim 215 further comprising the step of laminating and bonding cellulosic tissue to at least one of the web plies.

217. The method of claim 215 further comprising the step of laminating and bonding a melt blown polymeric fibrous web or mat to at least one of the stabilized webs of continuous filaments and melt blown fibers.

218. The method of claim 217 further comprising the step of laminating and bonding a web of melt blown polymeric fibers containing cellulosic tissue to at least one of the stabilized webs of continuous filaments and melt blown fibers.

219. The method of claim 217 further comprising the step of laminating and bonding a web of melt blown fibers containing cellulosic fibers and super absorbents to at least one of the stabilized webs of continuous filaments and melt blown fibers.

220. The method of claim 209 further comprising the step of laminating and bonding cellulosic, tissue to at least one of the web plies.

221. The method of claim 209 further comprising the step of laminating an melt blown polymeric fibrous web or mat to at least one of the stabilized webs of continuous filaments and melt blown fibers.

222. The method of claim 221 further comprising the step of laminating and bonding a web of melt blown polymeric fibers containing cellulosic tissue to at least one of the stabilized webs of continuous filaments and melt blown fibers.

223. The method of claim 221 further comprising the step of laminating and bonding a web of melt blown fibers containing cellulosic fibers and super absorbents to at least one of the stabilized webs of continuous filaments and melt blown fibers.

224. A method of forming non-woven fabric comprising the steps of:

a. forming first and second curtains of one or more rows of closely spaced continuous filaments by spinning molten polymer streams;
b. mechanically drawing the continuous filaments of the first and second curtains;
c. directing a stream of melt blown fibers onto one side of each of the first and second curtains of drawn continuous filaments thereby forming bonds at the cross over points of the melt blown fibers and locking in place the drawn continuous filaments to produce stabilized first and second webs of longitudinal, substantially parallel, drawn, and substantially continuous filaments, said air stream having a temperature in the range of about 250° F. to about 900° F.;
d. cross lapping each of the first and second stabilized webs to form first and second webs of transversely crossing plies of drawn filaments onto a conveyor;
e. autogenously bonding the first and second cross lapped webs together in discrete compacted areas; and
f. collecting said autogenously bonded web.

225. The method of claim 224 further comprising the step of laminating and bonding cellulosic tissue to at least one of the web plies.

226. The method of claim 224 further comprising the step of laminating and bonding a melt blown polymeric fibrous web or mat to at least one of the stabilized webs of continuous filaments and melt blown fibers.

227. The method of claim 226 further comprising the step of laminating and boding a web of melt blown polymeric fibers containing cellulosic tissue to at least one of the stabilized webs of continuous filaments and melt blown fibers.

228. The method of claim 226 further comprising the step of laminating and bonding a web of melt blown fibers containing cellulosic fibers and super absorbents to at least one of the stabilized webs of continuous filaments and melt blown fibers.

229. A method of forming a non-woven fabric comprising the steps of:

a. forming one or more rows of closely spaced filaments by spinning molten streams of one or more polymers;
b. drawing and stretching said continuous filaments mechanically;
c. directing an air stream containing melt blown molten fibers onto at least one side of the rows of drawn continuous filaments to form bonds at least at some of the intersections with the continuous filaments and to form fusion bonds to at least some of the intersections of the molten melt blown fibers with each other, thereby locking in place the continuous filaments to produce a stabilized web of longitudinal substantially parallel, drawn, continuous filaments, said air stream having a temperature in the range of about 250° F. to about 900° F.;
d. cross lapping or cross laying said stabilized web to form a web of plies of transversely crossing filaments;
e. autogenously bonding the plies of the cross lapped or cross laid web in discrete compacted areas; and
f. collecting said autogenously bonded web.

230. The method of claim 229 further comprising the steps of:

a. forming a second web of cross lapped plies of stabilized continuous filaments and melt blown fibers; and
b. passing the stabilized webs through two temperature controlled rolls to thereby autogenously bond the first and second webs together in discrete compacted areas.

231. The method of claim 229 wherein the step of forming spaced filaments comprises the step of providing an elastomeric material for the filaments.

232. The method of claim 231 further comprising the step of tensioning the web while autogenously bonding the web plies.

233. The method of claim 232 wherein the steps of drawing and stretching the continuous filaments are independent of one another.

234. The method of claim 231 further comprising the step of applying tension to the continuous filaments prior to subjecting them to the stream of melt blown molten fibers.

235. The method of claim 231 wherein the step of forming spaced filaments comprises the step of providing an elastomeric material for all of the molten streams.

236. The method of claim 231 wherein the step of directing an air stream containing melt blown fibers comprises the step of providing an elastomeric material for the melt blown fibers.

237. The method of claim 229 wherein the step of directing an air stream containing melt blown fibers comprises the step of providing an elastomeric material for the melt blown fibers.

238. The method of claim 229 further comprising the step of bonding the cross lapped or cross layed stabilized web to one or more plies of cellulosic tissue prior to autogenously bonding the plies together.

239. The method of claim 229 further comprising the step of bonding the cross lapped or cross layed stabilized web to one or more plies of cellulosic tissue subsequent to autogenously bonding the plies together.

240. The method of claim 229 wherein the step of forming bonds at the junctions of the melt blown fibers and continuous filaments and at the cross over points of the melt blown fibers with themselves comprise the step of forming stick bonds between the melt blown fibers and continuous filaments and of the melt blown fibers with themselves.

241. The method of claim 229 wherein the step of directing an air stream containing melt blown molten fibers to product a stabilized web of longitudinal substantially parallel continuous filaments comprises the steps of producing a stabilized web of longitudinal continuous filaments having a substantially predetermined alignment.

* * * * *

UNITED STATES PATENT AND TRADEMARK OFFICE

CERTIFICATE OF CORRECTION

PATENT NO. : 4,910,064

DATED : March 20, 1990

INVENTOR(S) : Reinhardt N. Sabee

It is certified that error appears in the above—identified patent and that said Letters Patent is hereby corrected as shown below:

Column 25, Line 17:
Change the claim dependency to read:
--- 54 ---

Column 26, Line 8:
Change "filament" to --- filaments ---

Column 26, Line 61:
Delete "tee" and insert --- the ---

Column 27, Line 19:
After "least" and before "one" insert --- on ---

Column 29, Lines 18-19:
After "are" delete "elastomeric" and insert
--- pressure sensitive ---

Column 30, Line 36:
Change the claim dependency to read:
--- 118 ---

Column 30, Line 46:
After "fibers"delete "of" and insert --- or ---

Column 30, Lines 49-50:
After "adhesives." delete "wherein the transverse angle is 90°."

Column 32, Line 15:
Before "melt" delete "not" and insert --- hot ---

UNITED STATES PATENT AND TRADEMARK OFFICE

CERTIFICATE OF CORRECTION

PATENT NO. : 4,910,064

DATED : March 20, 1990

INVENTOR(S) : Reinhardt N. Sabee

It is certified that error appears in the above—identified patent and that said Letters Patent is hereby corrected as shown below:

Column 32, Line 20:
Change the claim dependency to read:
--- 177 ---

Column 32, Line 64:
After "closely" and before "molten" insert
--- spaced ---

Column 33, Line 22:
Change "junction" to --- junctions ---

Column 34, Line 50:
Change the claim dependency to read:
--- 180 ---

Column 34, Line 57:
Change the claim dependency to read:
--- 180 ---

Column 34, Lines 65-66:
After "blown" and before "melt" delete "not"
and insert --- hot ---

Column 35, Line 46:
Change "filament" to --- filaments ---

UNITED STATES PATENT AND TRADEMARK OFFICE

CERTIFICATE OF CORRECTION

PATENT NO. : 4,910,064

DATED : March 20, 1990

INVENTOR(S) : Reinhardt N. Sabee

It is certified that error appears in the above—identified patent and that said Letters Patent is hereby corrected as shown below:

Column 36, Line 9:
After "forming" delete "bons" and insert
--- bonds ---

Column 38, Line 58:
Change "fiber" to ---fibers ---

Column 38, Line 59:
After "one" and before "the" delete
"or" and substitute --- of ---

Column 39, Line 19:
After "laminating" and before "melt" delete
"an" and insert --- and bonding a ---

Signed and Sealed this

Third Day of September, 1991

*Attest:*

*Attesting Officer*

HARRY F. MANBECK, JR.

*Commissioner of Patents and Trademarks*